US007990034B2

(12) United States Patent
Cha et al.

(10) Patent No.: US 7,990,034 B2
(45) Date of Patent: Aug. 2, 2011

(54) FILTER AND PLASMA DISPLAY DEVICE THEREOF

(75) Inventors: Hong Rae Cha, Seoul (KR); Ji Hoon Sohn, Seoul (KR); Joon Kwon Moon, Seoul (KR); Woon Seo Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 590 days.

(21) Appl. No.: 12/035,657

(22) Filed: Feb. 22, 2008

(65) Prior Publication Data

US 2009/0026909 A1 Jan. 29, 2009

(30) Foreign Application Priority Data

Jul. 24, 2007 (KR) ..... 10-2007-0074045
Jul. 24, 2007 (KR) ..... 10-2007-0074046

(51) Int. Cl.
*H01J 61/40* (2006.01)

(52) U.S. Cl. ..... 313/112

(58) Field of Classification Search ..... 313/112, 313/582–587
See application file for complete search history.

(56) References Cited

U.S. PATENT DOCUMENTS

2006/0051586 A1 3/2006 Park et al.
2006/0250064 A1 11/2006 Park et al.
2007/0145897 A1 * 6/2007 Kim et al. ..... 313/582

FOREIGN PATENT DOCUMENTS

EP 1 339 082 8/2003
EP 1 677 336 7/2006
EP 1 770 750 4/2007

OTHER PUBLICATIONS

European Office Action dated Nov. 26, 2008.

* cited by examiner

*Primary Examiner* — Toan Ton
*Assistant Examiner* — Hana S Featherly
(74) *Attorney, Agent, or Firm* — KED & Associates LLP

(57) ABSTRACT

A filter for a display panel includes a base unit and an external light shielding sheet. The sheet includes a plurality of pattern units provided in spaced relation adjacent the base unit to absorb external light. The base unit includes a dye or pigment for absorbing light in a specific wavelength region, and refractive indexes of the pattern units are greater than a refractive index of the base unit. The pattern units may have the same or different refractive indexes.

24 Claims, 13 Drawing Sheets

FILTER AND PLASMA DISPLAY DEVICE THEREOF

BACKGROUND OF THE INVENTION

1. Field of the Invention

The present invention relates to a filter for a display panel, and more particularly, to a filter and a plasma display device thereof in which a sheet for protecting external light is manufactured and disposed at a front surface of a panel in order to shield external light incident upon the panel so that the bright room contrast of the panel is enhanced while maintaining the luminance of the panel.

2. Description of the Conventional Art

Generally, a plasma display panel (PDP) displays images including text and graphic images by applying a predetermined voltage to a plurality of electrodes installed in a discharge space to cause a gas discharge and then exciting phosphors with the aid of plasma generated according to the gas discharge. The PDP is easy to manufacture as large-dimension, light and thin flat displays. In addition, the PDP has advantages in that it can provide wide vertical and horizontal viewing angles, full colors and high luminance.

In the meantime, external light is reflected from a front surface of the PDP due to white phosphors that are exposed on a lower substrate of the PDP when the PDP displays black images. For this reason, the PDP may mistakenly recognize the black images as being brighter than they actually are, thereby causing contrast degradation.

SUMMARY OF THE INVENTION

The present invention proposes to solve the above problems of the prior art. It is an object of the present invention to provide a plasma display device capable of efficiently shielding external light incident upon the PDP so that the bright room contrast and the luminance of the panel are enhanced.

A plasma display device of the present invention includes: a plasma display panel (PDP); and a filter formed in front of the panel, wherein the filter includes a base unit; and a sheet for protecting external light including a plurality of pattern units each formed to be spaced from the base unit to absorb external light, the base unit including dye and pigment absorbing light in a specific wavelength region.

A filter of the present invention in order to solve the above problems includes: a base unit; and a sheet for protecting external light including a plurality of pattern units each formed to be spaced from the base unit to absorb external light, wherein the base unit includes dye and pigment absorbing light in a specific wavelength region.

DETAILED DESCRIPTION OF THE PREFERRED EMBODIMENT

Figure 1:
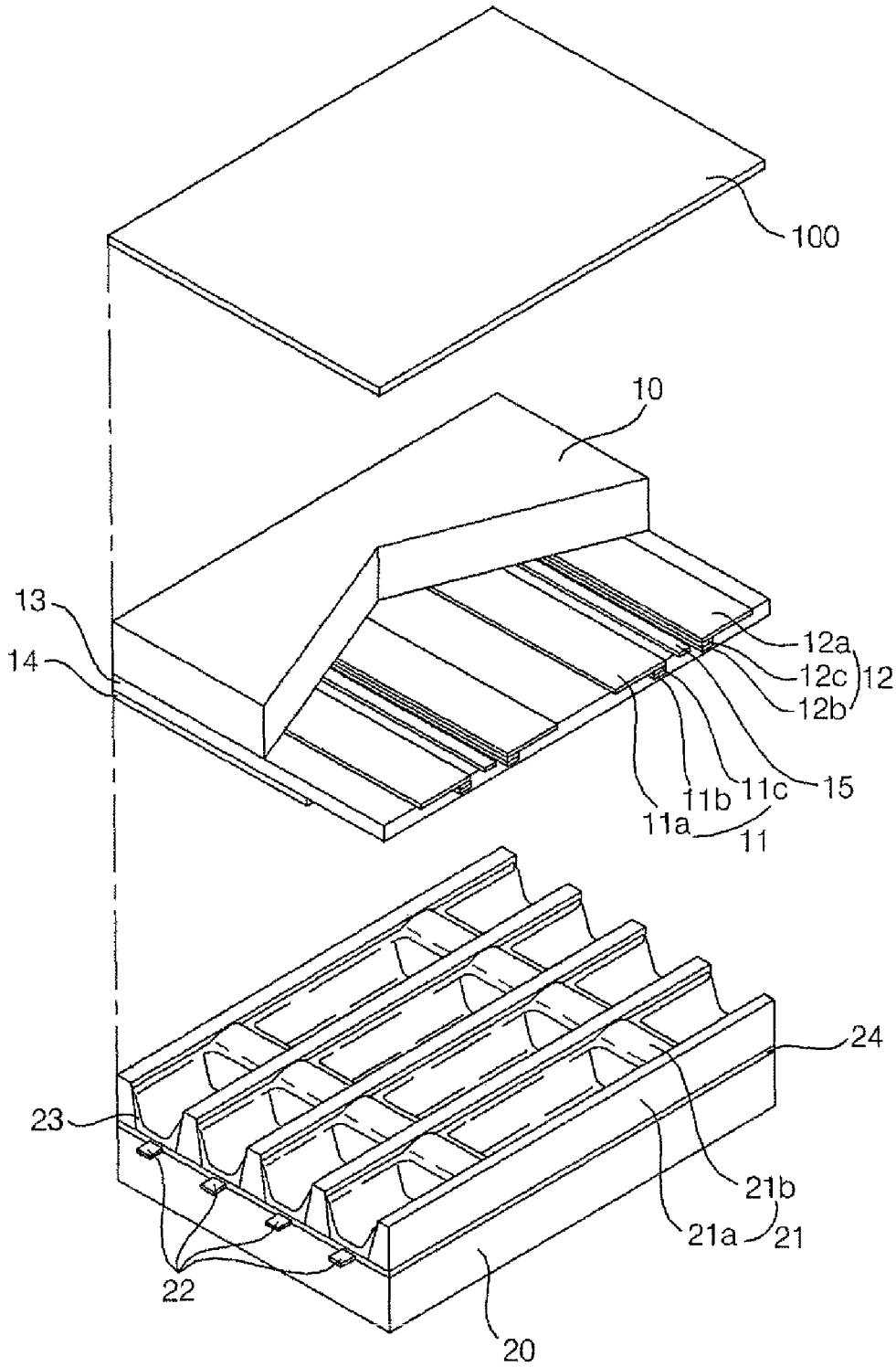
FIG. 1 is a perspective view illustrating a structure of a plasma display panel according to an embodiment of the present invention.

Hereinafter, the present invention will be described in detail with reference to the accompanying FIGS. 1 to 30, in which exemplary embodiments of the invention are shown. FIG. 1 is a perspective view illustrating a plasma display panel (PDP) according to an embodiment of the present invention.

As shown in FIG. 1, a PDP includes a scan electrode 11 and a sustain electrode 12, which are a sustain electrode pair formed on an upper substrate 10, and an address electrode 22 formed on a lower substrate 20.

The sustain electrode pair 11 and 12 include transparent electrodes 11*a* and 12*a* and bus electrodes 11*b* and 12*b* that are generally made of indium-tin-oxide (ITO). The bus electrodes 11*b* and 12*b* can be made of a metal such as silver (Ag) and chrome (Cr) or can be made with a stacked structure of chrome/copper/chrome (Cr/Cu/Cr) or chrome/aluminum/chrome (Cr/Al/Cr). The bus electrodes 11*b* and 12*b* are formed on the transparent electrodes 11*a* and 12*a* to reduce voltage drop due to the transparent electrodes 11*a* and 12*a* having high resistance.

Meanwhile, according to an embodiment of the present invention, the sustain electrode pair 11 and 12 can be composed of a stacked structure of the transparent electrodes 11*a* and 12*a* and the bus electrodes 11*b* and 12*b* or only the bus electrodes 11*b* and 12*b* without the transparent electrodes 11*a* and 12*a*. Because the latter structure does not use the transparent electrodes 11*a* and 12*a*, there is an advantage in that a cost of manufacturing a panel can be decreased. The bus electrodes 11*b* and 12*b* used in the structure can be made of various materials such as a photosensitive material in addition to the above-described materials.

A black matrix (BM), which performs a light protecting function of reducing reflection by absorbing external light that is generated from the outside of the upper substrate 10 and a function of improving purity and contrast of the upper substrate 10, may be disposed between the transparent electrodes 11*a* and 12*a* and the bus electrodes 11*b* and 12*b* of the scan electrode 11 and the sustain electrode 12.

The black matrix according to an embodiment of the present invention is formed on the upper substrate 10 and includes a first black matrix 15 that is formed at a position that is overlapped with a barrier rib 21 and second black matrixes 11*c* and 12*c* that are formed between the transparent electrodes 11*a* and 12*a* and the bus electrodes 11*b* and 12*b*. Here, the first black matrix and the second black matrixes 11*c* and 12*c* that are also referred to as a black layer or a black electrode layer may be physically connected to each other when they are formed at the same time in a forming process or may be not physically connected to each other when they are not formed at the same time.

In addition, when they are physically connected to each other, the first black matrix 15 and the second black matrixes 11*c* and 12*c* are made of the same material, but when they are physically separated from each other, they may be made of different materials.

It is also possible for bus electrodes 11*b* and 12*b* and the barrier rib 21 to perform a light protecting function of reducing reflection by absorbing external light generated from the outside and a function of improving contrast such as the black matrixes, as the bus electrodes 11*b* and 12*b* and the barrier rib 21 are dark colored. Otherwise, it is also possible to perform a function of the black matrix by making the overlapped portion viewed from the front looks like black color, as a specific element, for example a dielectric layer 13, formed in the upper substrate 10, and a specific element, for example the barrier rib 21, formed in the lower substrate 20 are complementarily colored.

An upper dielectric layer 13 and a protective film 14 are stacked in the upper substrate 10 in which the scan electrode 11 and the sustain electrode 12 are formed in parallel. Charged particles, which are generated by a discharge, are accumulated in the upper dielectric layer 13 and perform a function of protecting the sustain electrode pair 11 and 12. The protective film 14 protects the upper dielectric layer 13 from sputtering of charged particles that are generated at a gas discharge and enhances emission efficiency of a secondary electron.

In addition, the address electrode 22 is formed in an intersecting direction of the scan electrode 11 and the sustain electrode 12. Furthermore, a lower dielectric layer 24 and a barrier rib 21 are formed on the lower substrate 20 in which the address electrode 22 is formed.

In addition, a phosphor layer 23 is formed on the surface of the lower dielectric layer 24 and the barrier rib 21. In the barrier rib 21, a vertical barrier rib 21*a* and a horizontal barrier rib 21*b* are formed in a closed manner and the barrier rib 21 physically divides a discharge cell and prevents ultraviolet rays and visible light that are generated by a discharge from leaking to adjacent discharge cells.

Referring to FIG. 1, a filter 100 is preferably formed at the front of the PDP according to the present invention, and the filter 100 may include a sheet for protecting external light, an AR (Anti-Reflection) sheet, an NIR (Near Infrared) shielding sheet and an EMI (ElectroMagnetic Interference) shielding sheet, a diffusion sheet and an optical property sheet.

In case that an interval between the filter 100 and the PDP is 10 μm to 30 μm, it is possible to effectively shield light incident upon the PDP from the outside and to effectively emit light generated from the PDP to the outside. Also, the interval between the filter 100 and the PDP may be 30 μm to 120 μm in order to protect the PDP from the external pressure, etc., and an adhesion layer, which absorbs impact, may be formed between the filter 100 and the PDP.

In an embodiment of the present invention, various shapes of barrier rib 21 structure as well as the barrier rib 21 structure as shown in FIG. 1 can be used. For example, a differential barrier rib structure in which the vertical barrier rib 21*a* and the horizontal barrier rib 21*b* have different heights, a channel type barrier rib structure in which a channel, which can be used as an exhaust passage, is formed in at least one of the vertical barrier rib 21*a* and the horizontal barrier rib 21*b*, and a hollow type barrier rib structure in which a hollow is formed in at least one of the vertical barrier rib 21*a* and the horizontal barrier rib 21*b*, can be used.

In the differential type barrier rib structure, it is more preferable that height of the horizontal barrier rib 21*b* is higher than that of the vertical barrier rib 21*a* and in the channel type barrier rib structure or the hollow type barrier rib structure, it is preferable that a channel or a hollow is formed in the horizontal barrier rib 21*b*.

Meanwhile, in an embodiment of the present invention, it is described as each of R, G, and B discharge cells is disposed on the same line, but they may be disposed in other shapes. For example, delta type of arrangement in which the R, G, and B discharge cells are disposed in a triangle shape may be also used. Furthermore, the discharge cell may have various polygonal shapes such as a quadrilateral shape, a pentagonal shape, and a hexagonal shape.

Furthermore, the phosphor layer 23 emits light by ultraviolet rays that are generated at a gas discharge and generates any one visible light among red color R, green color G, or blue color B light. Here, inert mixed gas such as He+Xe, Ne+Xe, and He+Ne+Xe for performing a discharge is injected into a discharge space that is provided between the upper/lower substrates 10, 20 and the barrier rib 21.

Figure 2:
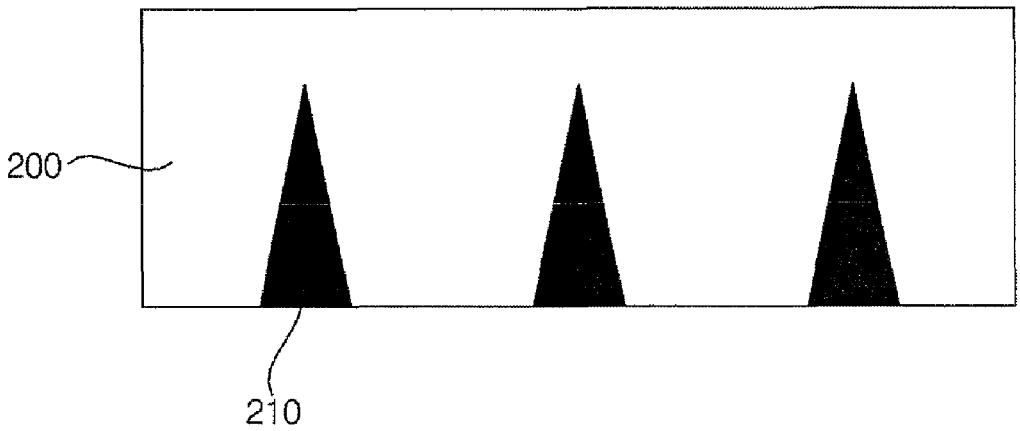
FIG. 2 is a cross-sectional view schematically illustrating a cross-sectional structure of a sheet for protecting external light according to an embodiment of the present invention.

FIG. 2 is a cross-sectional view illustrating a structure of a sheet for protecting external light provided in the filter according to the present invention, and the sheet for protecting external light includes a base unit 200 and pattern units 210.

The base unit 200 is preferably formed of a transparent plastic material, for example a UV-hardened resin-based material, so that light can smoothly transmit therethrough. Alternately, it is possible to use a hard glass material to protect the front of the PDP.

Referring to FIG. 2, the pattern units 210 may be formed as various shapes as well as triangles. The pattern units 210 are formed of a darker material than the base unit 200, preferably, formed of a black material. For example, the pattern units 210 are formed of a black carbon-based material or covered with a black dye in order to maximize the absorption of external light. Hereinafter, a wider one between the upper end and the lower end of the pattern unit 210 is referred to as a lower end of the pattern unit 210.

According to FIG. 2, the lower end of the pattern unit 210 may be disposed at a panel side, and the upper end of the pattern unit 210 may be disposed at a viewer side. Also, the lower end of the pattern unit 210 may also be disposed at the PDP side, and the upper end of the pattern unit 210 may be disposed at the viewer side, contrary to the above arrangement.

In general, an external light source is mostly located over the PDP, and thus, external light is diagonally incident on the PDP from the upper side and is absorbed in the pattern unit 210.

The pattern unit 210 may include a light-absorbing particle, and the light-absorbing particle may be a resin particle colored by a specific color. In order to maximize the light absorbing effect, the light-absorbing particle is preferably colored by a black color.

In order to maximize the absorption of external light and to facilitate the manufacture of the light-absorbing particle and the insertion into the pattern unit 210, the size of the light-absorbing particle may be 1 μm or more. Also, in case that the size of the light-absorbing particle is 1 μm or more, the pattern unit 210 may include the light-absorbing particle of 10% weight or more in order to more effectively absorb external light refracted into the pattern unit 210. That is, the light-absorbing particle of 10% weight or more of the total weight of the pattern unit 210 may be included in the pattern unit 210.

FIGS. 3 to 6 are cross-sectional views illustrating a structure of a sheet for protecting external light according to an embodiment of the present invention in order to explain optical property in accordance with the structure of the sheet for protecting external light.

Figure 3:
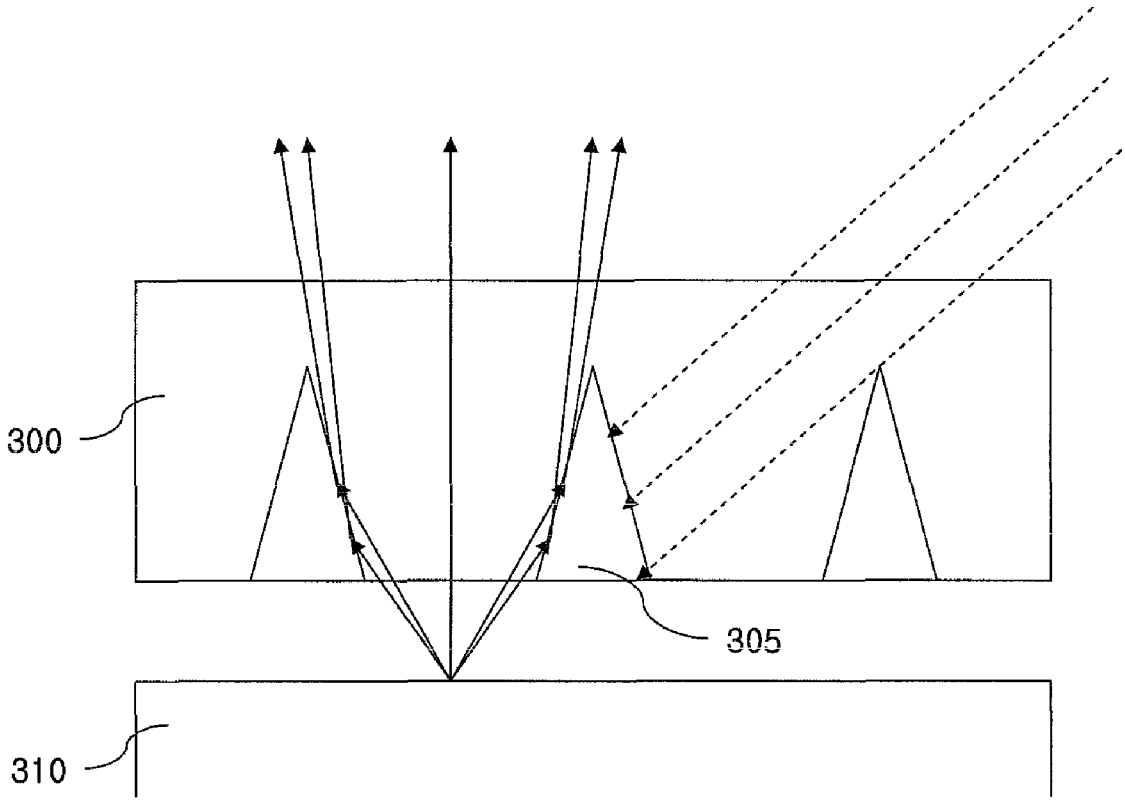
FIGS. 3 to 6 are cross-sectional views illustrating optical property according to a structure of a sheet for protecting external light.

Referring to FIG. 3, a refractive index of the pattern unit 305, particularly, a refractive index of at least the slanted surface of the pattern unit 305 is lower than a refractive index of the base unit 300 in order to enhance the reflectivity of light emitted from the PDP by totally reflecting visible light emitted from the PDP.

As described above, external light which reduces the bright room contrast of the PDP is highly likely to be above the PDP. Referring to FIG. 3, according to Snell's law, external light (illustrated as a dotted line) that is diagonally incident upon the sheet for protecting external light is refracted into and absorbed by the pattern unit 310 which has a lower refractive index than the base unit 300. External light refracted into the pattern unit 305 may be absorbed by the light absorption particle.

Also, light (illustrated as a solid line) that is emitted from the PDP 310 for displaying is totally reflected from the slanted surface of the pattern unit 305 to the outside, i.e., toward the viewer.

As described above, external light (illustrated as a dotted line) is refracted into and absorbed by the pattern unit 305 and light (illustrated as a solid line) emitted from the PDP 310 is totally reflected by the pattern unit 305 because the angle between the external light and the slanted surface of the pattern unit 305 is greater than the angle between the light emitted from the PDP 310 and the slanted surface of the pattern unit 305, as illustrated in FIG. 3.

Therefore, the sheet for protecting external light according to the present invention enhances the bright room contrast of the display image by absorbing the external light to prevent the external light from being reflected toward the viewer and by increasing the reflection of light emitted from the PDP 310.

In order to maximize the absorption of external light and the total reflection of light emitted from the PDP 310 in consideration of the angle of external light incident upon the PDP 310, the refractive index of the pattern unit 305 is preferably 0.3 to 1 times greater than the refractive index of the base unit 300. In order to maximize the total reflection of light emitted from the PDP 310 in consideration of the vertical viewing angle of the PDP, the refractive index of the pattern unit 305 is preferably 0.3 to 0.8 times greater than the refractive index of the base unit 300.

As shown in FIG. 3, when the upper end of the pattern unit 305 is disposed at the viewer side and the refractive index of the pattern unit 305 is lower than the refractive index of the base unit 300, a ghost phenomenon, that is, the phenomenon that an object is not clearly seen by a viewer may be occurred because light emitted from the PDP is reflected on the slanted surface of the pattern unit 305 toward the viewer side.

Figure 4:
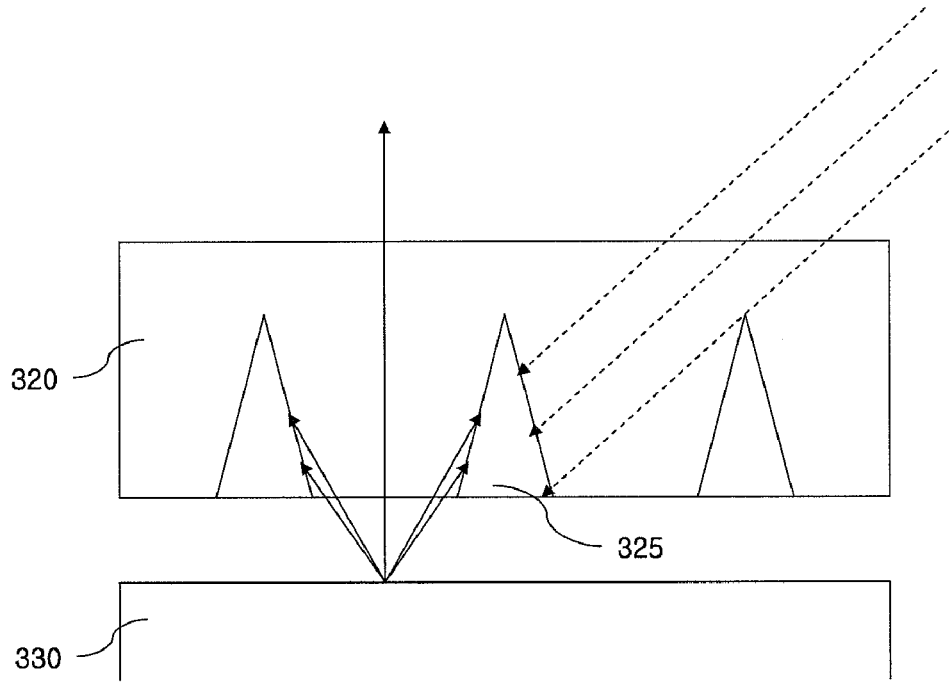

FIG. 4 illustrates the case that the upper end of the pattern unit 325 is disposed at the viewer side and the refractive index of the pattern unit 325 is higher than the refractive index of the base unit 320. Referring to FIG. 4, the refractive index of the pattern unit 320 is greater than the refractive index of the base unit 320, according to Snell's law, external light that is incident upon the pattern unit 325 is totally absorbed by the pattern unit 325.

Therefore, the ghost phenomenon may be reduced when the upper end of the pattern unit 325 is disposed at the viewer side and the refractive index of the pattern unit 325 is higher than the refractive index of the base unit 320. A difference between the refractive index of the pattern unit 325 and the refractive index of the base unit 320 is preferably 0.05 and more in order to prevent the ghost phenomenon by sufficiently absorbing light emitted from the PDP that is diagonally incident upon the pattern unit 325.

When the refractive index of the pattern unit 325 is higher than the refractive index of the base unit 320, light transmittance ratio of the sheet for protecting external light and bright room contrast may be reduced. Therefore, the difference between the refractive index of the pattern unit 325 and the refractive index of the base unit 320 is preferably 0.05 to 0.3 in order to prevent the ghost phenomenon and in order not to considerably reduce light transmittance ratio of the sheet for protecting external light. Also, the refractive index of the pattern unit 325 is preferably 1.0-1.3 times greater than the refractive index of the base unit 320 to prevent the ghost phenomenon while maintaining the bright room contrast at a proper level.

Figure 5:
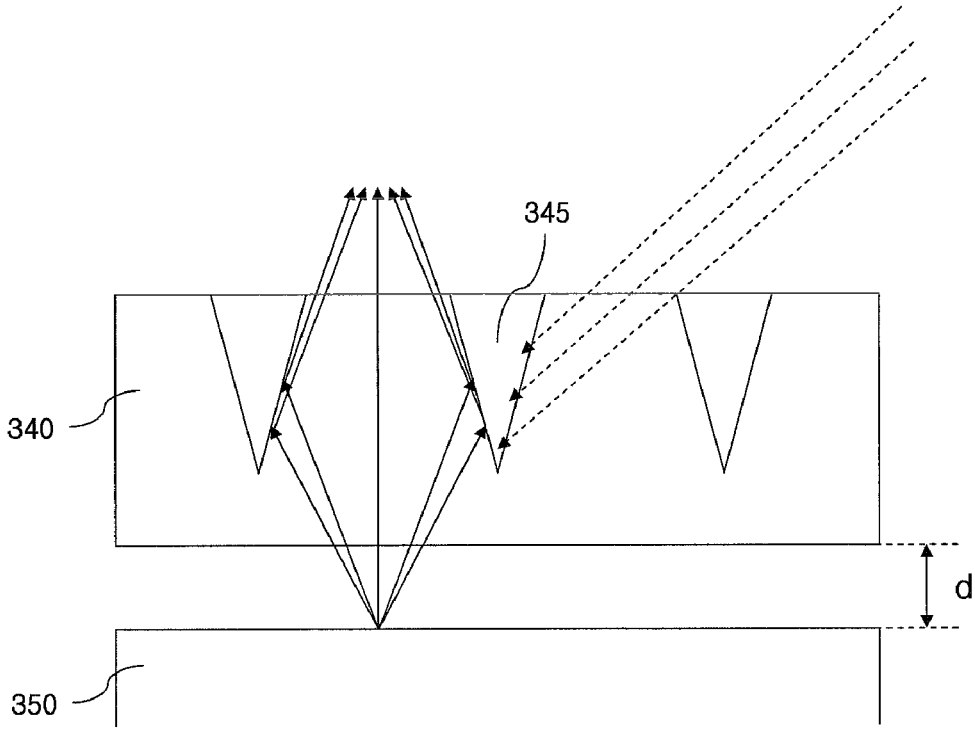

FIG. 5 illustrates the case that the lower end of the pattern unit 345 is disposed at the viewer side and the refractive index of the pattern unit 345 is lower than the refractive index of the base unit 340. As shown in FIG. 5, the external light protecting effect can be enhanced, as external light is allowed to be absorbed in the lower end of the pattern unit 345 by disposing the lower end of the pattern unit 345 at the viewer side on which external light incident. Also, an aperture ratio of the sheet for protecting external light can be enhanced because an interval between the lower ends of the pattern units 345 may be increased than the interval illustrated in FIG. 4.

As shown in FIG. 5, light emitted from the PDP 350 may be reflected at the slanted surface of the pattern unit 345 and be collected around light from the PDP which passes through the base unit 340. Therefore, the ghost phenomenon may be reduced without considerably lowering the light transmittance ratio of the sheet for protecting external light.

An interval d between the PDP 350 and the sheet for protecting external light is preferably 1.5 to 3.5 mm in order to prevent the ghost phenomenon as light from the PDP is reflected from the slanted surface of the pattern unit 345 and is collected around light from the PDP which passes through the base unit 340.

Figure 6:
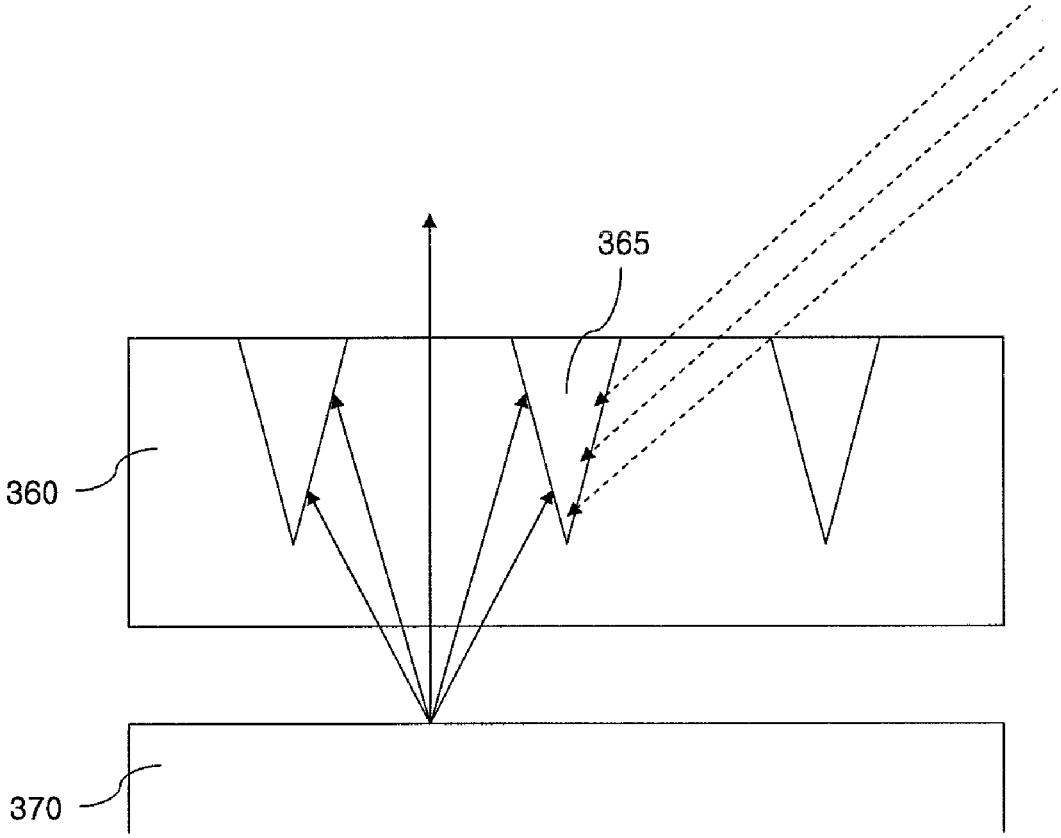

FIG. 6 illustrates the case that the lower end of the pattern unit 365 is disposed at the viewer side and the refractive index of the pattern unit 365 is higher than the refractive index of the base unit 360. As shown in FIG. 6, light from the PDP which is incident upon the slanted surface of the pattern unit 365 may be absorbed in the pattern units 365 because the refractive index of the pattern unit 365 is higher than the refractive index of the base unit 360. Therefore, the ghost phenomenon can be reduced, since images are displayed by light from the PDP which passes through the base unit 360.

In addition, the external light absorbing effect can be enhanced, since the refractive index of the pattern unit 365 is higher than the refractive index of the base unit 360.

Figure 7:
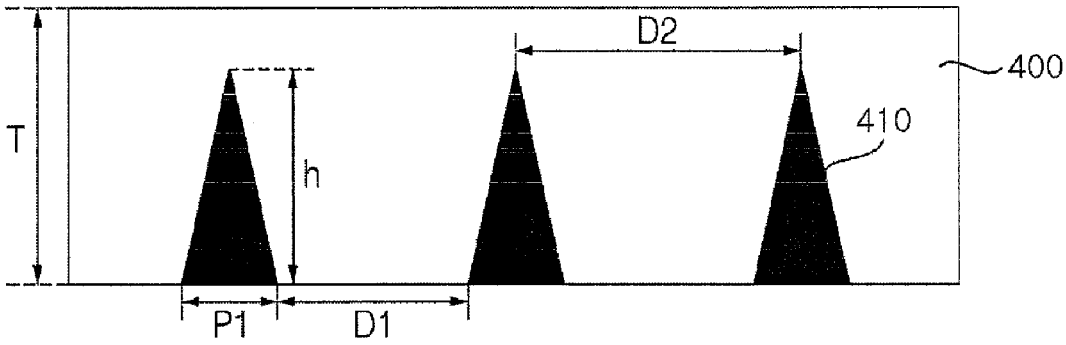
FIG. 7 is a cross-sectional view illustrating a shape of the pattern units of the sheet for protecting external light according to a first embodiment of the present invention.

FIG. 7 is a cross-sectional view illustrating a structure of a sheet for protecting external light provided in a filter according to the present invention. When a thickness T of the sheet for protecting external light is 20 μm to 250 μm, the manufacture of the sheet for protecting external light can be facilitated and the appropriate light transmittance ratio of the sheet for protecting external light can be obtained. The thickness T may be set to 100 μm to 180 μm in order to smoothly transmit light emitted form the PDP, to effectively absorb and protect external light refracted into the pattern unit 410 and to enhance the durability of the sheet for protecting external light.

Referring to FIG. 7, the pattern unit 410 formed on the base unit 400 may be formed as a triangle, and more preferably, as equilateral triangles. Also, the lower end width P1 of the pattern unit 410 may be 18 μm to 36 μm, and in this case, it is possible to ensure an optimum aperture ratio and maximize external light protecting efficiency so that light emitted from the PDP can be smoothly discharged toward an user side.

The height h of the pattern unit 410 is set to 80 μm to 170 μm, and thus, it is possible to make a gradient of the slanted surface capable of effectively absorbing external light and reflecting light emitted from the PDP. Also, it is possible to prevent the pattern unit 410 from being short-circuited.

In order to assure a sufficient aperture ratio to display images with optimum luminance through discharge of light emitted from the PDP toward the user side and to provide an optimum gradient of the slanted surface of the pattern unit 410 for enhancing the external light protecting efficiency and the reflection efficiency, an interval D1 between the pattern units adjacent each other may be set to 40 μm to 90 μm, and an interval D2 between the upper ends of the pattern units adjacent each other may be set to 90 μm to 130 μm.

Due to the above-described reasons, an optimum aperture ratio for displaying images can be obtained when the interval D1 is 1.1 to 5 times greater than the lower end width P1 of the pattern unit 410. Also, in order to obtain an optimum aperture ratio and to optimize the external light protecting efficiency and the reflection efficiency, the interval D1 between the lower ends of the pattern units 410 adjacent each other may be set to 1.5 to 3.5 times greater than the lower end width of the pattern unit 410.

When the height h of the pattern unit 410 is 0.89 to 4.25 times greater than the interval D1 between the pattern units adjacent each other, external light diagonally incident upon the sheet for protecting external light from above can be prevented from being incident upon the PDP. Also, in order to prevent the pattern unit 410 from being short-circuited and to optimize the reflection efficiency of light emitted from the PDP, the height h of the pattern unit 410 may be set to 1.5 to 3 times greater than the interval D1 between the pattern units adjacent each other.

In addition, when the interval D2 between the upper ends of the pattern units adjacent each other is 1 to 3.25 times greater than the interval D1 between lower ends of the pattern units adjacent each other, a sufficient aperture ratio for displaying images with optimum luminance can be obtained. Also, in order to maximize the total reflection efficiency of light emitted from the PDP by the slanted surface of the pattern unit 410, the interval D2 between the upper ends of the pattern units adjacent each other may be set to 1.2 to 2.5 times greater than the interval D1 between lower ends of the pattern units adjacent each other.

Although a structure of the sheet for protecting external light according to the present invention has been explained with the case where the upper end of the pattern unit 410 is disposed at a viewer side, it is also applicable to the case where the lower end of the pattern unit 410 is disposed at a viewer side with reference to FIG. 7.

Figure 8:
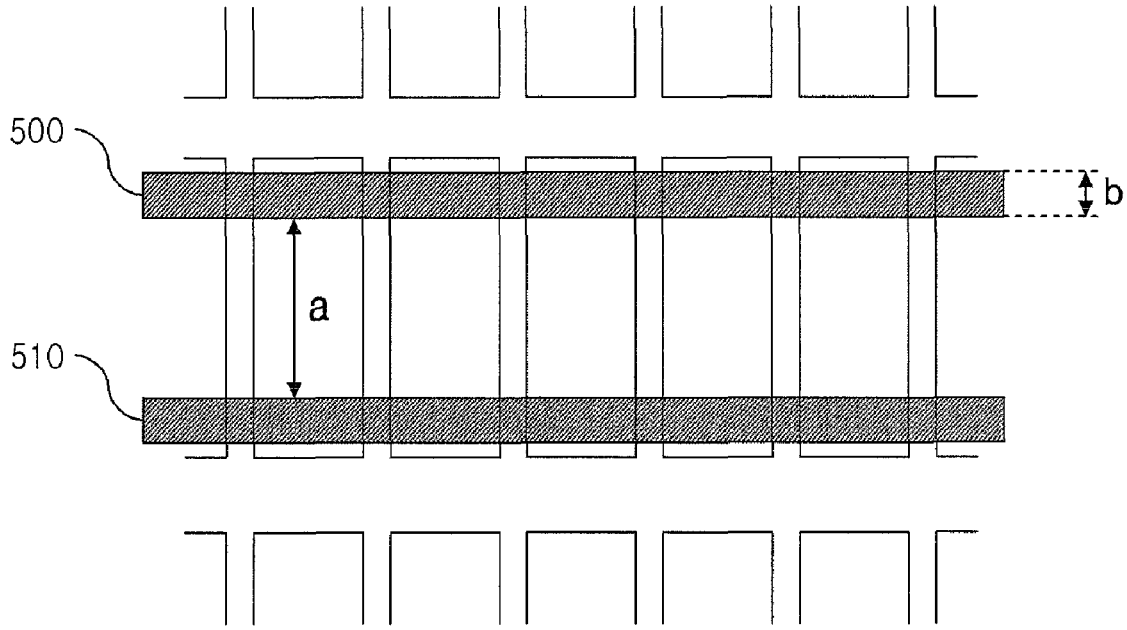
FIG. 8 is a cross-sectional view illustrating a structure of a bus electrode formed on an upper substrate of the panel according to the embodiment of the present invention.

FIG. 8 is a cross-sectional view illustrating a structure of a bus electrode formed on an upper substrate of a PDP according to the present invention.

As explained with reference to FIG. 7, the interval between the pattern units of the sheet for protecting external light, adjacent to each other, is preferably set to 40 μm to 90 μm, and when the interval a between the two bus electrodes 500 and 510 formed on the upper substrate of the PDP, adjacent to each other, is 225 μm to 480 μm, the aperture ratio of the PDP for obtaining optimum luminance of display images can be obtained and at the same time, a discharge starting voltage can be reduced. Therefore, when the interval a between two bus electrodes 500 and 510 adjacent to each other is 2.5 to 12 times greater than the interval between two pattern units adjacent to each other, optimum aperture ratio of the PDP can be obtained as well as the external light protecting efficiency can be maximized and the reflection efficiency of the light emitted from the PDP can be optimized.

Also, in order to reduce the moire phenomenon generated due to the overlap of the pattern unit of the sheet for protecting external light and the bus electrode, the interval between the patter units adjacent to each other is preferably set to 40 μm to 60 μm, and an interval a between two bus electrodes 500 and 510, adjacent to each other, is preferably set to 225 μm to 480 μm. Therefore, when the interval a between two bus electrodes 500 and 510 adjacent to each, is 4 to 10 times greater than the interval between two pattern units adjacent to each other, optimum aperture ratio of the PDP can be obtained as well as the external light protecting efficiency can be maximized and the reflection efficiency of the light emitted from the PDP can be optimized simultaneously with reducing the moire phenomenon.

As explained with reference to FIG. 7, the lower end width of the pattern unit of the sheet for protecting external light is preferably set to 18 μm to 35 μm, and when the width b of the bus electrode 500 formed on the upper substrate of the PDP is 45 μm to 90 μm, optimum resistance and capacitance for driving the PDP can be obtained and the aperture ratio of the PDP for optimum luminance of display images can be obtained. Therefore, in order that the optimum resistance and capacitance for driving the PDP can be obtained and the aperture ratio of the PDP for optimum luminance of display images can be obtained, the lower end width of the pattern unit is preferably set to 0.2 to 0.8 times greater than the width b of the bus electrode 500.

Figure 9:
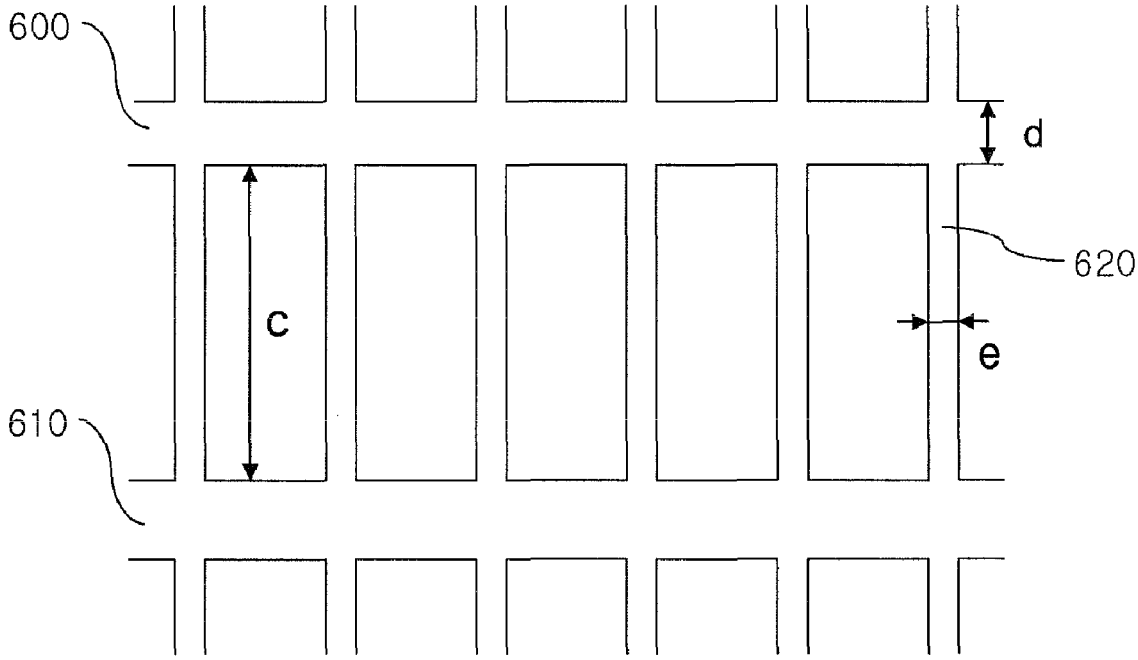
FIG. 9 is a view illustrating a structure of barrier ribs formed on a lower substrate of the panel according to the embodiment of the present invention.

FIG. 9 is a view illustrating a structure of a barrier rib formed on the lower substrate of a PDP, wherein the barrier rib includes a vertical barrier rib 620 formed in an intersecting direction with a bus electrode formed on the upper substrate and horizontal barrier ribs 600 and 610 formed in an intersecting direction with the vertical barrier rib 620.

Considering the obtaining of optimum luminance of display images and resolution, the distance c between two horizontal barrier ribs 600 and 610 adjacent to each other may be set to 483 μm to 810 μm. Therefore, considering that the distance between two pattern units adjacent to each other is 40 μm to 90 μm, for obtaining the optimum aperture ratio of the PDP as well as for enhancing the external light shielding efficiency and the reflection efficiency of light emitted from the PDP, the distance c between two barrier ribs 600 and 610 adjacent to each other is preferably set to 5.4 to 20.3 times greater than the distance between two pattern units adjacent to each other.

Also, when the distance between the pattern units adjacent to each other is 40 μm to 60 μm and the distance c between the horizontal barrier ribs 600 and 610 adjacent to each other is 600 μm to 700 μm, the moire phenomenon generated due to the overlapping the pattern units of the sheet for protecting external light with the horizontal barrier ribs of the PDP can be reduced. Therefore, when the distance between two horizontal barrier ribs 600 and 610 adjacent to each other is 10 to 17.5 times greater than the distance between two pattern units adjacent to each other, the light shielding efficiency of reducing reflection by absorbing external light that is generated from the outside and the efficiency of improving purity and contrast of the upper substrate can be maximized simultaneously with reducing the moire phenomenon.

As explained with reference to FIG. 7, the lower end width of the pattern units of the sheet for protecting external light is preferably set to 18 μm to 35 μm, and when the upper end width d of the horizontal barrier rib 600 is 45 μm to 90 μm, optimum aperture ratio of the PDP for obtaining optimum luminance of display images can be obtained. Therefore, in order that the optimum aperture ratio of the PDP for optimum luminance of display images can be obtained and the moire phenomenon generated due to the overlapping the pattern units of the sheet for protecting external light and the horizontal barrier ribs of the PDP can be reduced, the lower end width of the pattern units is preferably set to 0.2 to 0.8 times greater than the upper end width d of the horizontal barrier rib 600.

Figure 10:
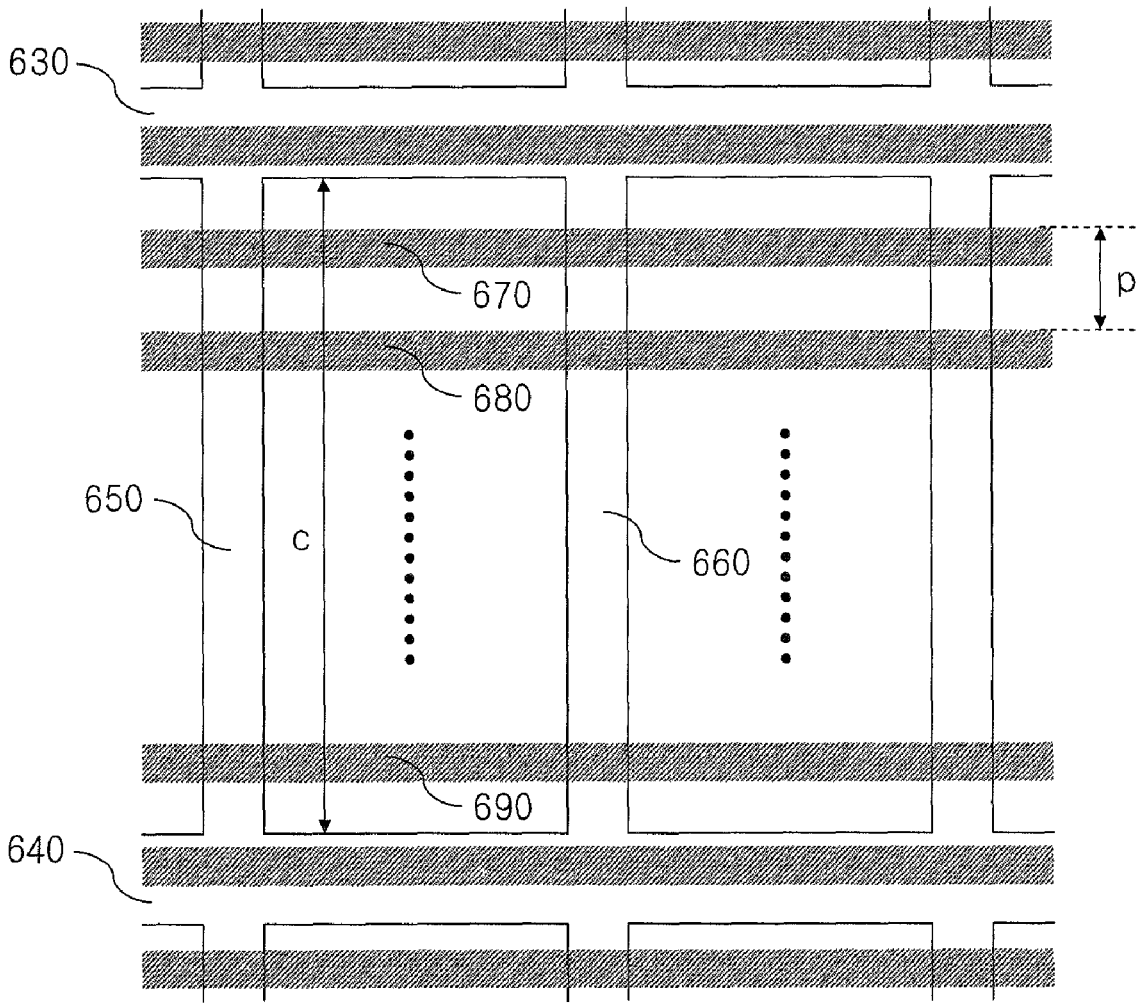
FIG. 10 is a view illustrating an embodiment of a structure where the pattern units of the sheet for protecting external light of the present invention are overlapped with a discharge cell of the panel thereof.

FIG. 10 is a view illustrating an embodiment of a structure where pattern units of the sheet for protecting external light of the present invention are overlapped with a discharge cell of the panel thereof.

As shown in FIG. 10, one discharge cell partitioned by means of horizontal barrier ribs 630 and 640 and vertical barrier ribs 650 and 660 is overlapped with a plurality of pattern units 670, 680, and 690 of a sheet for protecting external light.

As explained with reference to FIG. 7, it is preferable that the lower end width of the pattern unit 670 is 18 μm to 35 μm, and the width between the two pattern units 670 and 680, adjacent to each other, is 40 μm to 90 μm. Therefore, it is preferable that the pitch p of the pattern units is 58 μm to 125 μm.

Referring to FIG. 10, the interval c between the two horizontal barrier ribs 630 and 640, adjacent to each other, may be 483 μm to 810 μm, and the pitch p of the pattern units may be 58 μm to 125 μm, as described above, so that the interval c between the two horizontal barrier ribs 630 and 640, adjacent to each other, may be 3.0-13.0 times greater than the pitch p of the pattern units.

Therefore, it is preferable that the average number the pattern units 670, 680, and 690 overlapped with one discharge cell is 3.9 to 13.9 in order to obtain aperture ratio of 50% to 80% for sufficiently emitting panel light towards a user side and accordingly, in order to enhance external light absorbing efficiency simultaneously with enhancing luminance of display images.

Also, in case of a 42-inch XGA resolution panel, assuming that the interval c between the two horizontal barrier ribs 630 and 640, adjacent to each other, is about 675 μm, the average number of the pattern units 670, 680, and 690 overlapped with one discharge cell may be 5.4 to 11.6.

In case of a 42-inch Full HD resolution panel, assuming that the interval c between the two horizontal barrier ribs 630 and 640, adjacent to each other, is about 483 μm, the average number of the pattern units 670, 680, and 690 overlapped with one discharge cell may be 3.9 to 8.3.

In case of a 50-inch XGA resolution panel, assuming that the interval c between the two horizontal barrier ribs 630 and 640, adjacent to each other, is about 810 μm, the average number of the pattern units 670, 680, and 690 overlapped with one discharge cell may be 6.5 to 13.9.

In case of a 50-inch Full HD resolution panel, assuming that the interval c between the two horizontal barrier ribs 630 and 640, adjacent to each other, is about 579 μm, the average number of the pattern units 670, 680, and 690 overlapped with one discharge cell may be 4.6 to 10.0.

Also, the pitch p of the pattern units may be 60 μm to 80 μm in order to reduce the generation of the moire phenomenon between the horizontal barrier ribs 630 and 650 of the PDP or the bus electrodes of the upper substrate of the PDP. Therefore, when the average number of the pattern units 670, 680, and 690 overlapped with one discharge cell is 6 to 13.6, the external light absorbing efficiency of the sheet for protecting external light and the moire phenomenon can be enhanced within the scope not remarkably degrading the luminance of the display images.

The moire phenomenon may occur, as a black matrix, a black layer, a bus electrode and a barrier rib, etc. formed in the display panel with a predetermined pattern and a plurality of pattern units formed in the sheet for protecting external light at a predetermined interval are overlapped. The moire phenomenon is a pattern of low frequency caused by the interference between periodic images, for example there is a pattern in the shape of wave when mosquito nets are stacked.

Therefore, in the case of the sheet for protecting external light according to the present invention, it diagonally forms the plurality of pattern units, making it possible to reduce moire phenomenon generated due to the overlapping with the black matrix, the black layer, the bus electrode, and the barrier ribs, etc.

FIGS. 11 to 14 are cross-sectional views illustrating a structure of a filter including a sheet for protecting external light according to embodiments of the present invention.

Figure 11:
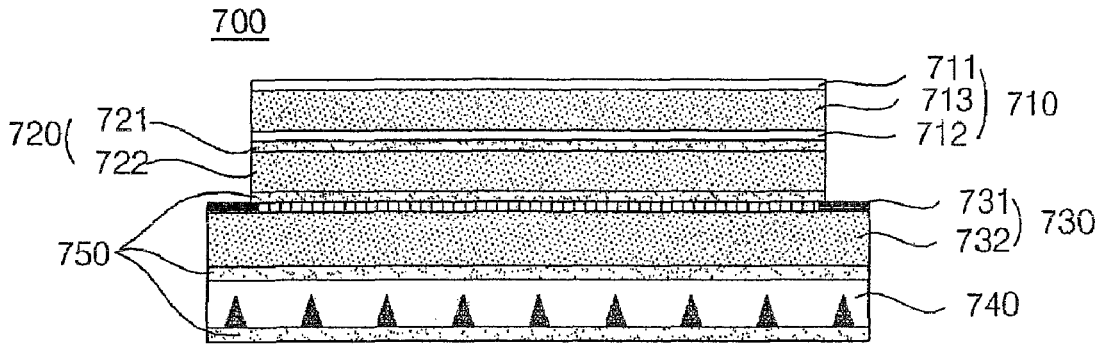
FIGS. 11 to 14 are cross-sectional views illustrating a structure of a filter including the sheet for protecting external light according to embodiments of the present invention.
Figure 12:
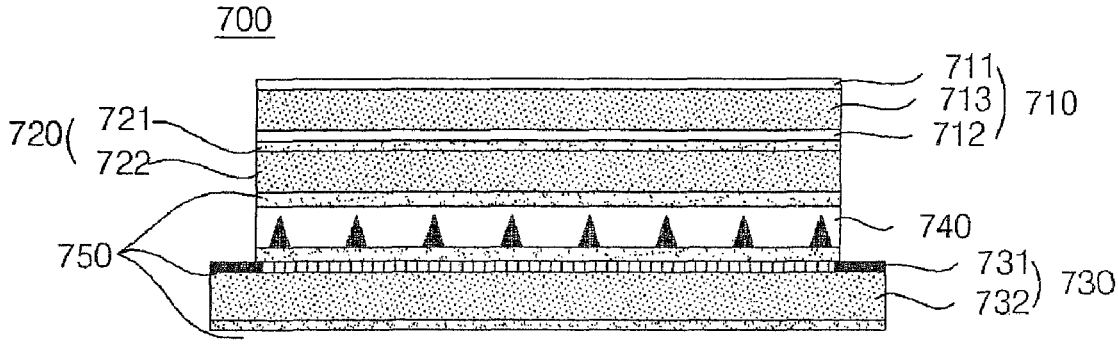

Referring to FIGS. 11 and 12, the filter 700 formed at a front of the PDP may include an anti-reflection (AR)/near infrared (NIR) sheet 710, an optical property sheet 720, an electromagnetic interference (EMI) sheet 730, a sheet for protecting external light 740.

The anti-reflection AR layer 711 which is attached onto a front surface of the base sheet 713 and reduces glare by preventing the reflection of external light from the outside is attached onto the AR/NIR sheet 710, and a near infrared (NIR) shielding sheet 712 which protects NIR rays emitted from the PDP so that signals provided by a device such as a remote control which transmits signals using infrared rays can be normally transmitted is attached onto a rear surface of the AR/NIR sheet.

The optical property sheet 720 can enhance temperature color, color purity or luminance property of the light incident upon the PDP, and it may be attached with an optical property layer 721 made of a predetermined dye and adhesive material may be stacked at the front surface or the rear surface of a base sheet 722 formed of transparent plastic material.

The EMI shielding sheet 720 is attached with an EMI shielding sheet 721 protecting the EMI on the front surface of the base sheet 722 formed of transparent plastic material to prevent the EMI emitted from the PDP from being emitted outside. For example, the EMI shielding sheet 721 may be formed in a mesh structure using a conductive material, wherein the non-effective display region of the EMI shielding sheet, which dose not display images, may be entirely coated with a conductive material in order to smoothly perform the ground.

Also, the filter according to the present invention includes the sheet for protecting external light 730 so that external light is effectively shielded and thus black images of the PDP can be rendered even blacker.

An adhesive layer 750 is interposed between the AR/NIR sheet 710, the optical property sheet 720, the EMI shielding sheet 730 and the sheet for protecting external light 740, so that the respective sheets 710, 720, 730, and 740 and the filter 700 can be firmly attached onto the front surface of the PDP. Also, the base sheets interposed between the respective sheets 710, 720, 730, and 740 are preferably made of the same material in order to facilitate the manufacture of the filter.

Meanwhile, according to FIG. 11, the AR/NIR sheet 710, the optical property sheet 720, the EMI shielding sheet 730, and the sheet for protecting external light 740 are sequentially stacked. Alternatively, the AR/NIR sheet 710, the optical property sheet 720, the sheet for protecting external light 740 and the EMI shielding sheet 730 may be sequentially stacked, as shown in FIG. 12. The stack order of the respective sheets may be differently performed by persons having ordinary skill in the art. Also, at least one layer of the illustrated sheets 710, 720, 730, and 740 may be omitted.

A base unit of the sheet for protecting external light according to the present invention may include dye or pigment absorbing light in a specific wavelength region. For example, the base unit may include a NIR absorbing dye or pigment absorbing NIR rays, and a color correction dye or pigment correcting color temperature or color purity by absorbing light with a specific color such as neon light, etc. Also, the base unit may include various functional dye or pigment capable of changing the light property of the panel, for example, a functional dye allowing a color of a non-effective display region to be black when the PDP is not driven, in addition to the NIR absorbing dye or pigment and the color correction dye or pigment.

The NIR rays, which belong to a wavelength region of 700-1200 nm, may be generated by Xenon (X) emitting rays of 800 to 1100 nm when discharged, among inert gases filled in the PDP. If the NIR rays are emitted to the outside, signals of an apparatus transferring signals by using infrared rays (IR), such as a remote controller, etc., cannot be normally transferred to the PDP.

The base unit of the sheet for protecting external light according to the present invention can reduce the emission of the NIR rays from the PDP to the outside by including the NIR absorbing dye or pigment absorbing the NIR rays having a wavelength of 800 nm to 1100 nm.

As the NIR absorbing dye, dyes absorbing NIR rays having a wavelength of 800 nm to 1100 nm, such as a diimonium-based dye, a phthalocyanine-based dye, a naphthalocyanine-based dye, and a metal-complex-based dye, or a compound of these dyes, may be widely used.

The following chemical formula 1 represents the diimonium-based dye absorbing NIR rays.

[Chemical formula 1]

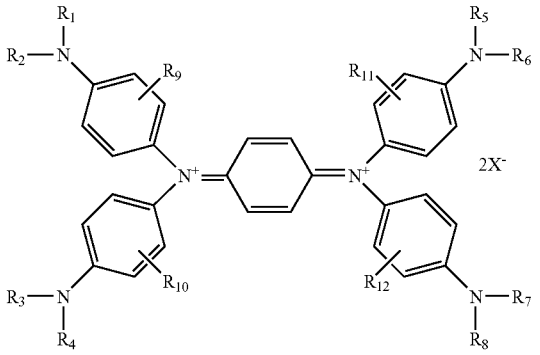

In the chemical formula 1, R1 to R12 each independently are a hydrogen atom, a halogen atom, a substituted or unsubstituted alkyl group having from 1 to 16 carbon atoms, and a substituted or unsubstituted aryl group having from 1 to 16 carbon atoms, and X is an univalent or divalent organic acid anion or an univalent or divalent inorganic acid anion.

In the chemical formula 1, as the univalent organic acid anion, there are an organic carboxylic acid ion, an organic sulfonic acid ion, and an organic boric acid ion, etc. As the organic carboxylic acid ion, there are an acetate ion, a lactate ion, a trifluoroacetate ion, a propionate ion, a benzonate ion, oxalate ion, a succinate ion, or a stearate ion. Also, as the organic sulfonic acid ion, there are a metal sulfonate ion, a toluene sulfonate ion, a naphthalene monosulfonate ion, a chlorobenzene sulfonate ion, a nitrobenzene sulfonate ion, a dodecylbenzene sulfonate ion, a benzene sulfonate ion, an ethan sulfonate ion, or a trifluoromethan sulfonate ion. As the organic boric acid ion, a tetraphenylborate ion or a butyltriphenylborate ion is preferable.

Also, as the univalent inorganic acid anion, there is a halogenite ion, for example, preferably, a fluoride ion, a chloride ion, a bromide ion, an iodide ion, a thiocyanate ion, a hexafluoroantimononate ion, a perchlorate ion, a periodate ion, a niterate ion, a teterfluoroborate ion, a hexafluorophosphate ion, a molybdate ion, a tungstate ion, a titanate ion, a vanadate ion, a phosphate ion, and a borate ion. Also, as the divalent anion, there are preferably naphthalene-1,5-disulfonic acid, naphthalene-1,6-disulfonic acid, and naphthalene disulfonic acid derivatives, etc.

The following chemical formula 2 represents the phthalocyanine-based dye absorbing NIR rays.

[Chemical formula 2]

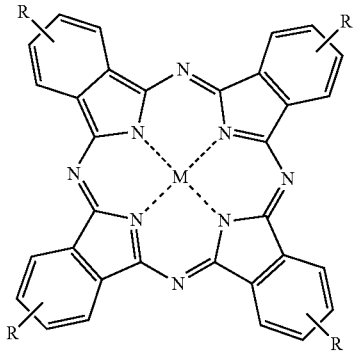

The following chemical formula 3 represents the naphthalocyanine-based dye absorbing NIR rays.

[Chemical formula 3]

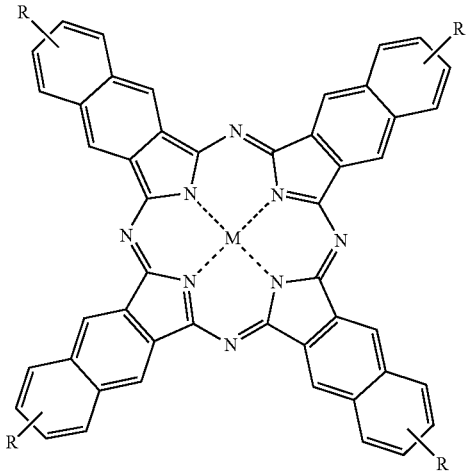

In the chemical formulas 2 and 3, R each independently are a hydrogen atom, a halogen atom, a substituted or unsubstituted alkyl group having from 1 to 16 carbon atoms, a substituted or unsubstituted phenyl group, a substituted or unsubstituted alkoxy group having from 1 to 5 carbon atoms, a substituted or unsubstituted aryloxy group, a fluorinesubstituted alkoxy group, or a pentagonal ring having one or more substituted or unsubstituted nitrogen atom. And, M represents any one of two hydrogen atoms, a divalent metal atom, a trivalent or tetravalent substituted metal atom and an oxymetal, preferably, nickel, platinum, palladium or copper.

The following chemical formulas 4 and 5 represent the metal-complex-based dye absorbing NIR rays.

[Chemical formula 4]

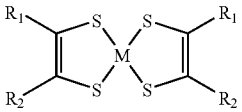

[Chemical formula 5]

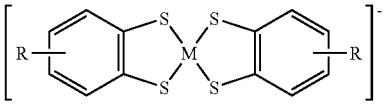

In the chemical formulas 4 and 5, R and R1 to R4 independently are hydrogen, an alkyl group having from 1 to 16 carbon atoms, an aryl group, or an alkoxy group, a phenoxy group, a hydroxy group, an alkyl amino group having from 1 to 16 carbon atoms, an aryl amino group, a trifluoro metal group, an alkyl thio group having from 1 to 16 carbon atoms, an aryl thio group, a nitro group, a cyano group, a halogen atom, a phenyl group, or a naphthalene group.

A weight ratio between the base unit and the NIR absorbing dye may be 10:1 to 10000:1. The weight ratio may be varied according to the molar extinction coefficient of the NIR absorbing dye or the transmissivity which intends to be shield. The NIR transmissivity of the sheet for protecting external light including the NIT absorbing dye is preferably 10% or less.

A wavelength of light emitted from a red phosphor of the PDP is located between 560 nm to 630 nm, wherein a neon light degrades purity of red light.

The base unit of the sheet for protecting external light according to the present invention includes a neon-cut dye or pigment absorbing the neon light having a wavelength of 570 nm to 600 nm, making it possible to enhance purity of red light.

The neon-cut dye is dye of which half band with is 50 nm or less and use a dye having a metal-complex shape within molecules or between molecules.

For example, the neon-cut dye may be a porphyrin-based dye having a metal-complex shape within molecules as indicated as the following chemical formula 6, a cyanin-based dye having a metal-complex shape between molecules or the compound of these dyes as indicated as the following chemical formulas 7 and 8.

Also, as the neon-cut dye, dyes absorbing the neon light having a wavelength of 570 nm to 600 nm, such as an amine-based dye or a polymethine-based dye, etc., may be widely used.

[Chemical formula 6]

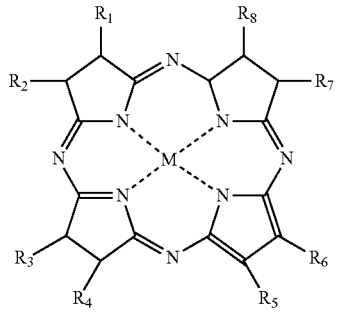

[Chemical formula 7]

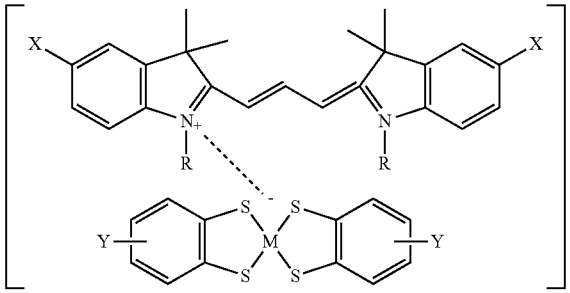

[Chemical formula 8]

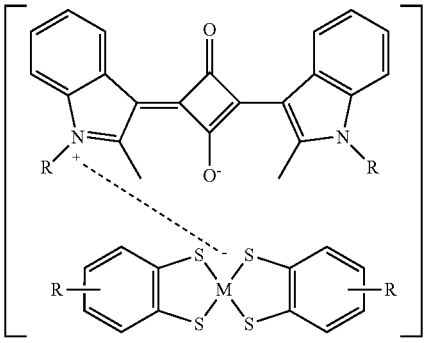

In the chemical formula 6, R1 to R8 independently are a hydrogen atom, a halogen atom, a substituted or unsubstituted alkyl group having from 1 to 16 carbon atoms, a substituted or unsubstituted alkoxy group; a substituted or unsubstituted phenyl group, a substituted or unsubstituted aryloxy group, a fluorinesubstituted alkoxy group, or a pentagonal ring having one or more substituted or unsubstituted nitrogen atom; M is metal having a ligand with a hydrogen atom, an oxygen atom, a halogen atom, or divalent to tetravalent metal atoms. In the chemical formulas 7 and 8, R each independently are a hydrogen atom, a substituted or unsubstituted aliphatic hydrocarbon having from 1 to 30 carbon atoms, an alkoxy group having from 1 to 8 carbon atoms, or an aryl group having from 1 to 30 carbon atoms; and X and Y each independently are a halogen, a nitro group, a carboxyl group, an alkoxy group having from 2 to 8 carbon atoms, a phenoxy carbonyl group, a carboxylate group, an alkyl group having from 1 to 8 carbon atoms, an alkoxy group having from 1 to 8 carbon atoms, or an aryl group having from 1 to 30 carbon atoms.

In the chemical formula 6, as the divalent metal atom of the M, there are Cu, Zn, Fe, Co, Ni, Ru, Rd, Pd, Mn, Sn, Mg, and Ti, etc.; as the trivalent 1-substituted metal atom, there are Al—Cl, Ga—Cl, In—Cl, Fe—Cl, and Ru—Cl, etc., wherein metal may be 1-substituted by a halogen atom, a hydroxyl group, and an alkoxyl group; as the tetravalent 2-substituted metal atom, there are SiCl2, GaCl2, TiCl2, SnCl2, Si(OH)2, Ge(OH)2, Mn(OH)2, and Sn(OH)2, etc., wherein a metal atom may be substituted by halogen, a hydroxyl group, and an alkoxyl group; and as the oxy-metal, there are Vo, MnO, and TiO etc., wherein oxygen may be bonded to metal.

A weight ratio between the base unit and the neon-cut dye may be 10:1 to 10000:1. The weight ratio may be varied according to the molar extinction coefficient of the neon-cut dye or the transmissivity which intends to be shielded.

The base unit of the sheet for protecting external light includes a color correction dye including at least one of an anthraquinone-based dye, a phthalocyanine-based dye, and a thioindigo-based dye, making it possible to correct color temperature or color purity of the PDP light For example, the base unit includes dye or pigment absorbing red light or green light, making it possible to control transmissivity or luminance of a specific color depending on the characteristics of the PDP, such as lowering the red or the green luminance of the PDP light and raising the blue luminance thereof, etc.

The base unit of the sheet for protecting external light may further include a cross linking agent or a coupling agent.

Figure 13:
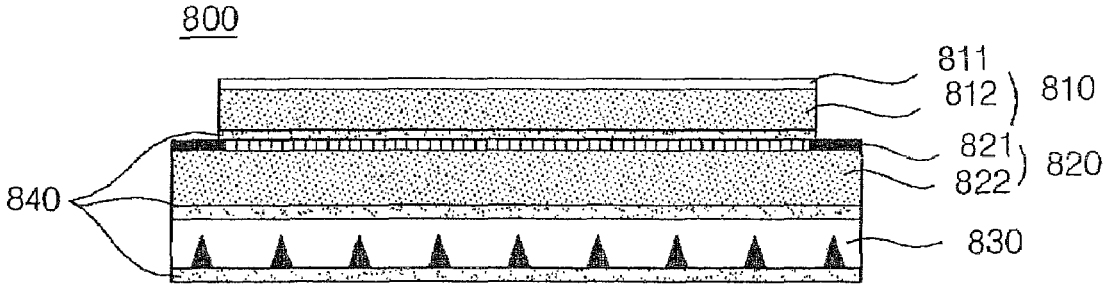
Figure 14:
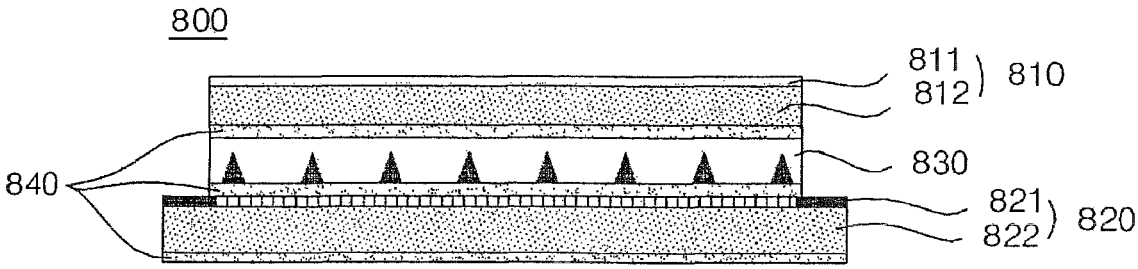

FIGS. 13 and 14 illustrate embodiments for a structure of a filter having a sheet for protecting external light including dye or pigment absorbing light in a specific wavelength region, and among the functions of the respective sheets as illustrated, an explanation of the same matters as those explained with reference to FIGS. 11 and 12 will be omitted.

Referring to FIGS. 13 and 14, a filter 800 formed at the front surface of the PDP may include an AR sheet 810, an EMI shielding sheet 820, and external light shielding sheet 830.

As described above, a base unit of the sheet for protecting external light 830 may include dye or pigment for shielding NIR rays, dye or pigment for absorbing a neon light, a color correction dye or pigment capable of controlling characteristics of other PDP light, and a functional dye or pigment.

As shown in FIG. 13, when the base unit of the sheet for protecting external light 830 includes the NIR absorbing dye or pigment, a separate NIR shielding sheet may not be provided in the filter. When the base unit of the sheet for protecting external light 830 includes the color correction/functional dye or pigment, a separate optical property sheet may not be provided in the filter. Thereby, a structure of the filter can be simplified, and a facilitation of manufacturing process can be enhanced simultaneously with reducing manufacturing costs of the filter.

In order that the respective sheets 810, 820, and 830 and the filter 800 can be firmly attached to the front of the PDP, an adhesive layer 840 may be included in the filter. It is preferable that base sheets between the respective sheets 810, 820, and 830 use the substantially same material as those therein, considering the manufacturing facilitation of the filter.

Meanwhile, according to FIG. 13, the AR sheet 810, the EMI shielding sheet 820, and the sheet for protecting external light 830 are sequentially stacked. Alternatively, the AR sheet 810, the sheet for protecting external light 830 and the EMI shielding sheet 820 may be sequentially stacked, as shown in FIG. 14. The stack order of the respective sheets may be differently performed by persons having ordinary skill in the art.

Also, even when the base unit of the sheet for protecting external light 830 includes dye or pigment for NIR rays shielding or color correction, etc., a separate NIR shielding sheet or optical property sheet may be provided in the filter, as shown in FIGS. 11 and 12, for reinforcing or adding functions.

At least one of the base sheets or one adhesive layer shown in FIGS. 11 to 14 may be abbreviated, and at least one of the base sheets may be formed of a hard glass instead of being formed of a plastic material, so that the protection of the PDP can be enhanced. It is preferable that the glass is formed at a predetermined spacing apart from the PDP.

In addition, the filter according to the present invention may further include a diffusion sheet. The diffusion sheet serves to diffuse light incident upon the PDP to maintain the uniform brightness. Therefore, the diffusion sheet may widen the vertical viewing angle and conceal the patterns formed on the sheet for protecting external light by uniformly diffusing light emitted from the PDP. Also, the diffusion sheet may enhance the front luminance as well as antistatic property by concentrating light in the direction corresponding to the vertical viewing angle.

A transmissive diffusion film or a reflective diffusion film can be used as a diffusion sheet. In general, the diffusion sheet may have the mixed form that small glass particles are mixed in the base sheet of polymer material. Also, PMMA may be used as a base sheet of the diffusion film. When PMMA is used as a base sheet of the diffusion film, it can be used in large display devices because thermal resistance of the base sheet is good enough despite of its thick thickness.

FIGS. 15 to 19 are cross-sectional views illustrating the shape of the pattern units of the sheet for protecting external light according to other embodiments of the present invention.

Figure 15:
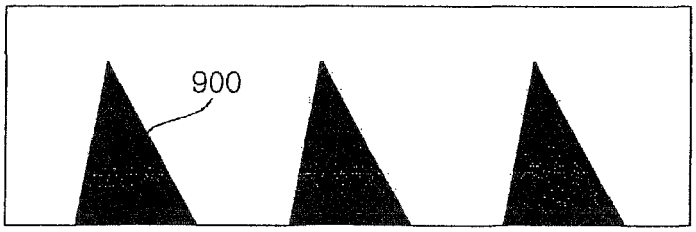
FIGS. 15 to 19 are cross-sectional views illustrating a shape of the pattern units of the sheet for protecting external light according to second to seventh embodiments of the present invention.

Referring to FIG. 15, the pattern units 900 may be horizontally asymmetrical. That is, left and right slanted surfaces of the pattern units 900 may have different areas or may form different angles with the lower end. In general, an external light source is located above the PDP, and thus, external light is highly likely to be incident upon the PDP from above within a predetermined angle range. Therefore, in order to enhance the absorption of external light and the reflection rate of light emitted from the PDP, upper slanted surface of two slanted surfaces of the pattern units 900 may be gentler than lower slanted surface. That is, the upper slanted surface of two slanted surfaces of the pattern units 900 may be less steep than lower slanted surface.

Figure 16:
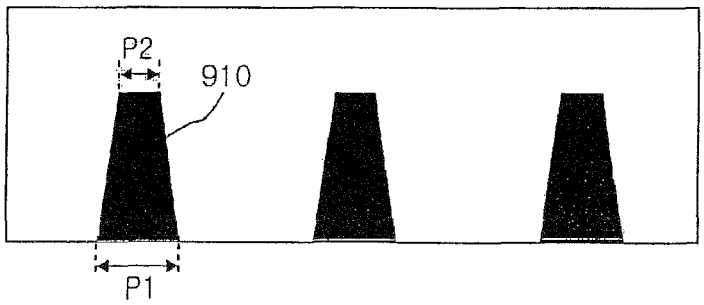

Referring to FIG. 16, the pattern units 910 may be trapezoidal, and in this case, an upper end width P2 of the pattern units is less than a lower end width P1 of the pattern units.

Also, the upper end width P2 of the pattern units 910 may be 10 μm or less, and therefore the slope of the slanted surfaces can be determined according to the relationship between the lower end width P1 so that the absorption of external light and the reflection of light emitted from the PDP can be optimized.

Figure 17:
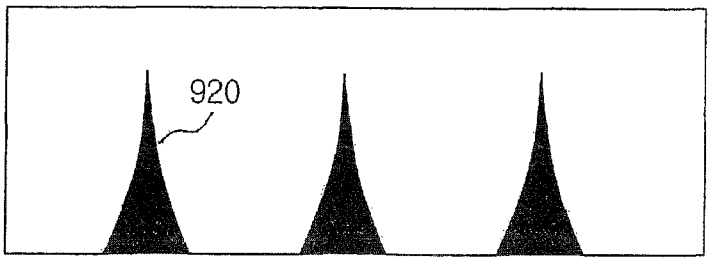
Figure 19:
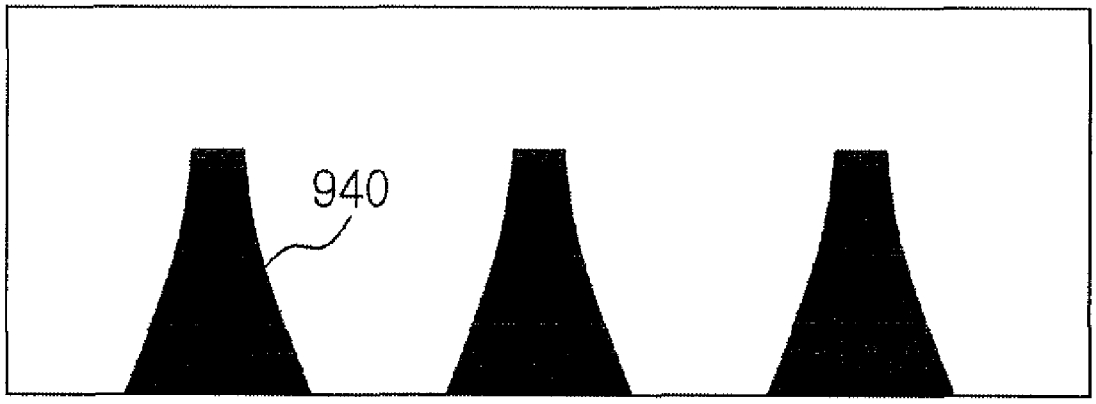

As shown in FIGS. 17 and 19, the pattern units 920, 930 and 940 of the sheet for protecting external light may have a curved profile having a predetermined curvature at the left and right slanted surfaces. In this case, the slope angle of the slanted surface of the pattern units 920, 930 and 940 is preferably getting gentle in a direction to the upper end from the lower end.

Figure 18:
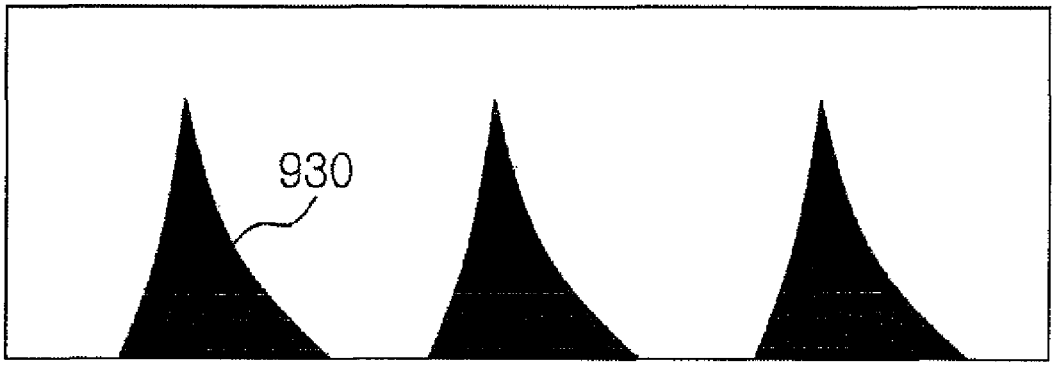

Also, according to the embodiments in respect to the shape of the pattern units shown in FIGS. 17 to 19, edge portion of the pattern units may have a curved profile having a predetermined curvature.

Figure 20:
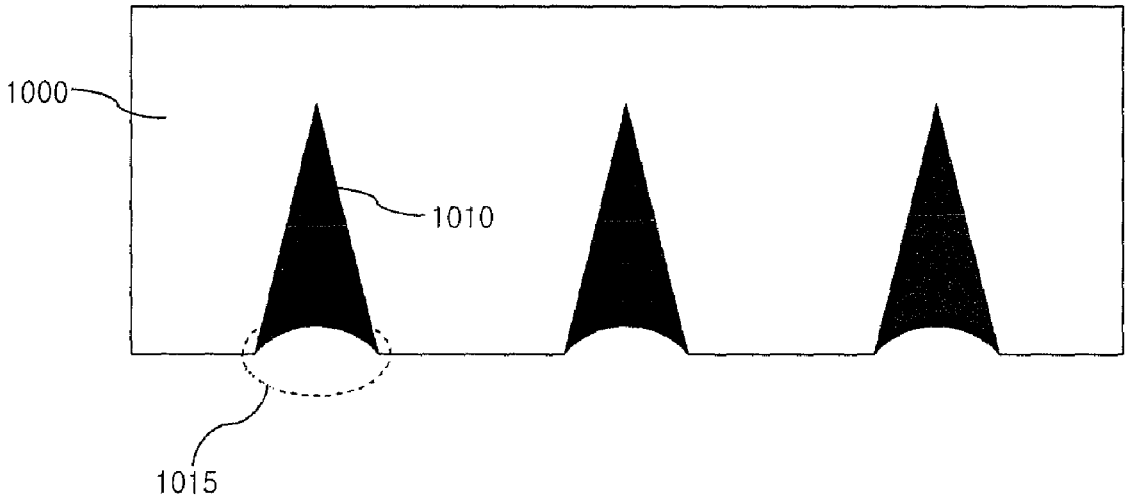
FIGS. 20 to 25 are cross-sectional views illustrating a cross-sectional shape of the pattern units of concave profile at the lower end of the pattern units according to embodiments of the present invention and explaining the optical property thereof.

FIG. 20 is a cross-sectional view illustrating the shape of the pattern units of concave profile at the lower end according to embodiments of the present invention.

As shown in FIG. 20, bleeding phenomenon of the image that is generated as light emitted from the PDP is reflected on the lower end 1015 of the pattern units can be reduced by forming a center of the lower end 1015 of the pattern units as a round hole or a concave. Also, when the sheet for protecting external light is attached to another functional sheet or the PDP, adhesive force can be enhanced as the area of the contact portion is increased.

That is, the pattern units 1010 having a concave lower end 1015 may be formed by forming the pattern units 1010 in which the height of the center area is lower than the height of the outer most contour.

The pattern units 1010 may be formed by filling light-absorbing materials into a groove formed in the base unit 1000, wherein some of the grooves formed in the base unit 1000 may be filled by the light-absorbing materials and the rest of the grooves may be left as an occupied space. Therefore, the lower end 1015 of the pattern units 1010 may be a concave shape in which the center area is depressed into the inside.

Figure 21:
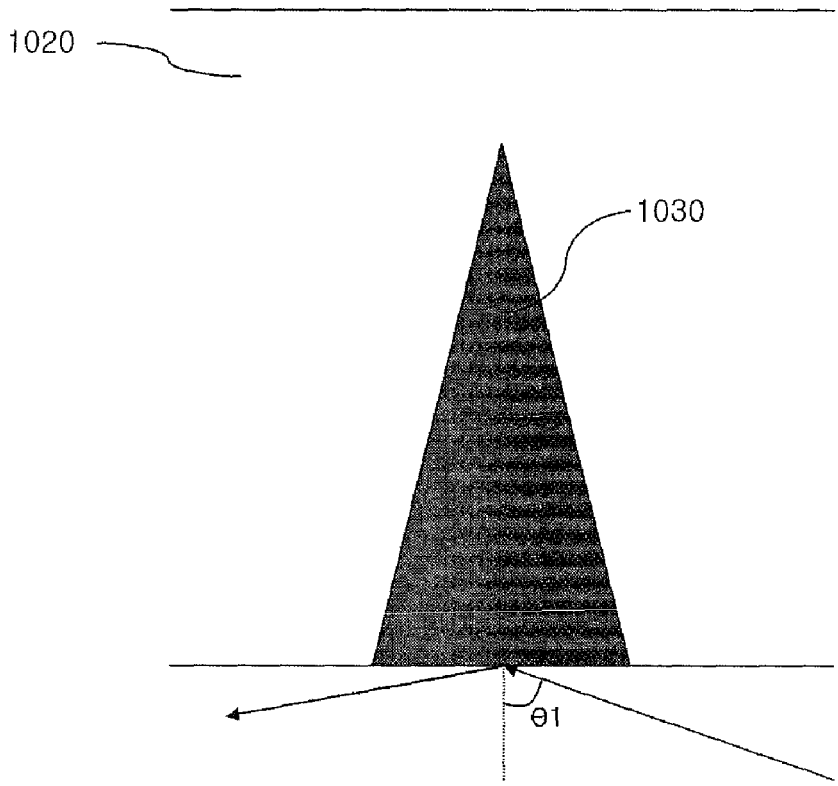
Figure 22:
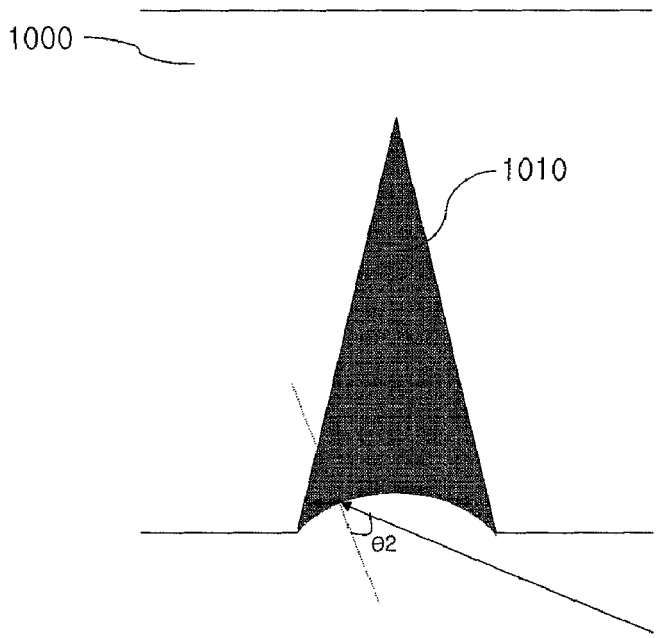

As shown in FIG. 21, light that is emitted from the PDP and diagonally incident upon the lower end of the pattern units 1030 may be reflected toward the PDP, when the lower end of the pattern units 1030 is flat. As images, to be displayed at a specific position by light reflected toward the PDP, are displayed around the specific position, and thus, the sharpness of the display images may be reduced because the bleeding phenomenon occurs.

Referring to FIG. 21, the incident angle θ2 that is diagonally incident upon the lower end of the pattern units 1010 having a depressed shape is smaller than the incident angle θ1 that is incident upon the lower end of the pattern units 1030 having a flat shape shown in FIG. 21. Therefore, the PDP light that is reflected on the lower end of the pattern units 1030 having a flat shape shown in FIG. 21 may be absorbed into the pattern units 1010 at the lower end of the pattern units 1010 having a depressed shape shown in FIG. 22. Therefore, the sharpness of the display images may be enhanced by reducing the bleeding phenomenon of the display images.

Figure 23:
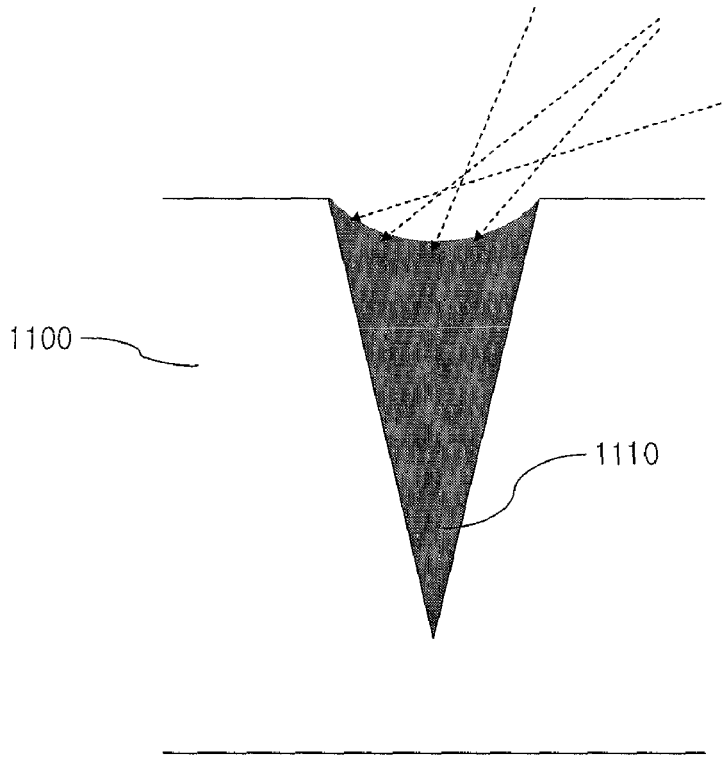

FIG. 23 is a cross-sectional view illustrating a structure of the sheet for protecting external light with the pattern units 1110 having a concave shape at the lower end, which is disposed at a viewer side.

Referring to FIG. 23, incident angle range of external light that is absorbed in the lower end of the pattern units 1110 can be increased by forming the lower end of the pattern units 1110 as a concave. That is, when the lower end of the pattern units 1110 is formed as a concave, the incident angle of external light that is incident upon the lower end of the pattern units 1110 may be increased, and thus, the absorption of external light can be increased.

Figure 24:
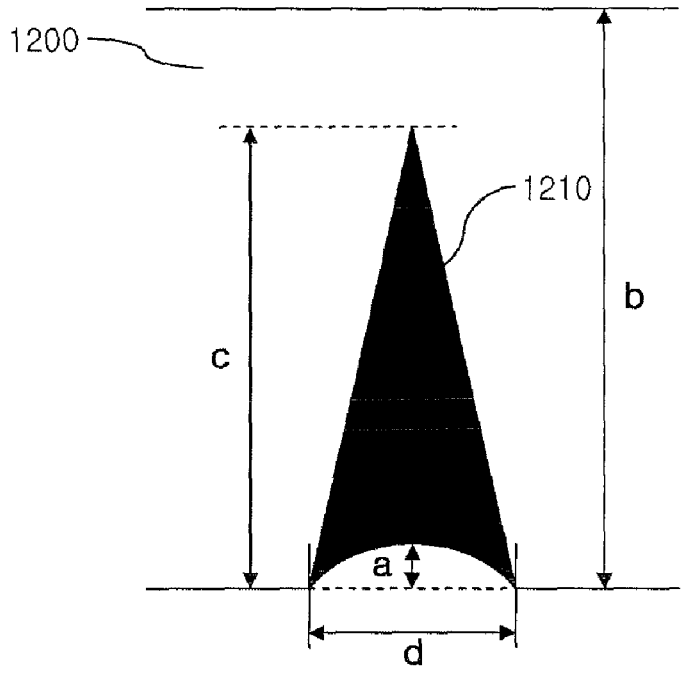

FIG. 24 is a cross-sectional view illustrating the shape of the pattern units having a concave shape at the lower end according to the embodiment of the present invention. Table 1 presents experimental results about the bleeding phenomenon of the display images according to the depth a of the groove of the width d of the pattern units 1210, that is, Table 1 presents experimental results about whether the bleeding phenomenon of images is reduced or not compared with the PDP in which the external light shielding panel having flat pattern units is disposed.

TABLE 1

| Depth (a) of groove | Lower end width (d) of pattern unit | Reduction of bleeding phenomenon |
|---|---|---|
| 0.5 μm | 27 μm | X |
| 1.0 μm | 27 μm | X |
| 1.5 μm | 27 μm | ○ |
| 2.0 μm | 27 μm | ○ |
| 2.5 μm | 27 μm | ○ |
| 3.0 μm | 27 μm | ○ |
| 3.5 μm | 27 μm | ○ |
| 4.0 μm | 27 μm | ○ |
| 4.5 μm | 27 μm | ○ |
| 5.0 μm | 27 μm | ○ |
| 5.5 μm | 27 μm | ○ |
| 6.0 μm | 27 μm | ○ |
| 6.5 μm | 27 μm | ○ |
| 7.0 μm | 27 μm | ○ |
| 7.5 μm | 27 μm | X |
| 8.0 μm | 27 μm | X |
| 9.0 μm | 27 μm | X |
| 9.5 μm | 27 μm | X |

As described in Table 1, the sharpness of the display images may be enhanced by reducing the bleeding phenomenon of the display images, when a depth a of the depressed groove formed in the lower end of the pattern units 1210 is 1.5 μm to 7.0 μm.

Also, the depth a formed in the lower end of the pattern units 1210 is preferably 2 μm to 5 μm in consideration of the protection of the pattern units 1210 from the exterior pressure, and the manufacturing facilitation of the pattern units 1210.

As described in the above with reference to FIG. 7, it is possible to ensure an optimum aperture ratio and to maximize external light shielding efficiency, when a lower end width d of the pattern units 1210 is 18 μm to 35 μm, and thus, the lower end width d of the pattern units 1210 is preferably set to 3.6 to 17.5 times greater than a depth a of a groove formed in the lower end of the pattern units 1210.

Meanwhile, it is possible to form a gradient of the slanted surface capable of optimizing the absorption of external light and the reflection of light emitted from the PDP, when a height c of the pattern units 1210 is 80 μm to 170 μm, and thus, the height c of the pattern units 1210 is preferably set to 16 to 85 times greater than the depth a of the groove formed in the lower end of the pattern units 1210.

Also, the thickness b of the sheet for protecting external light is preferably set to 20 to 90 times greater than the depth a of the groove formed in the lower end of the pattern units 1210, because it is possible to obtain the appropriate transmittance of light emitted from the PDP, the absorption and the shielding as well as the durability of the sheet for protecting external light when the thickness b of the sheet for protecting external light is 100 μm to 180 μm.

Figure 25:
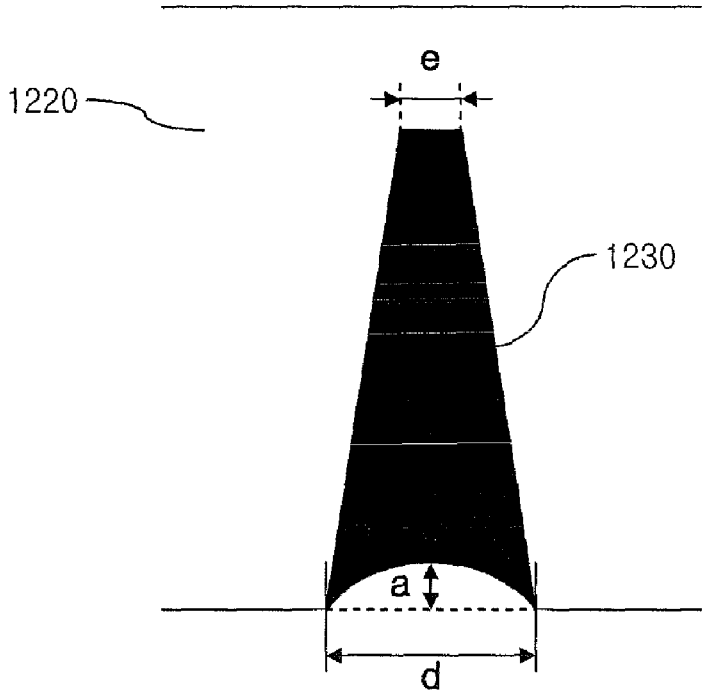

Referring to FIG. 25, the pattern units 1230 may be trapezoidal, and in this case, the upper end width e of the pattern units is preferably less than the lower end width d of the pattern units. Also, when the upper end width e of the pattern units 1230 is 10 μm or less, the slope of the slanted surfaces can be determined according to the relationship between the lower end width d so that the absorption of external light and the reflection of light emitted from the PDP can be optimized. In this case, the relationship between the upper end width e of the pattern units 1230 and the lower end width d of the pattern units 1230 may be the same as shown in FIG. 24.

Figure 26:
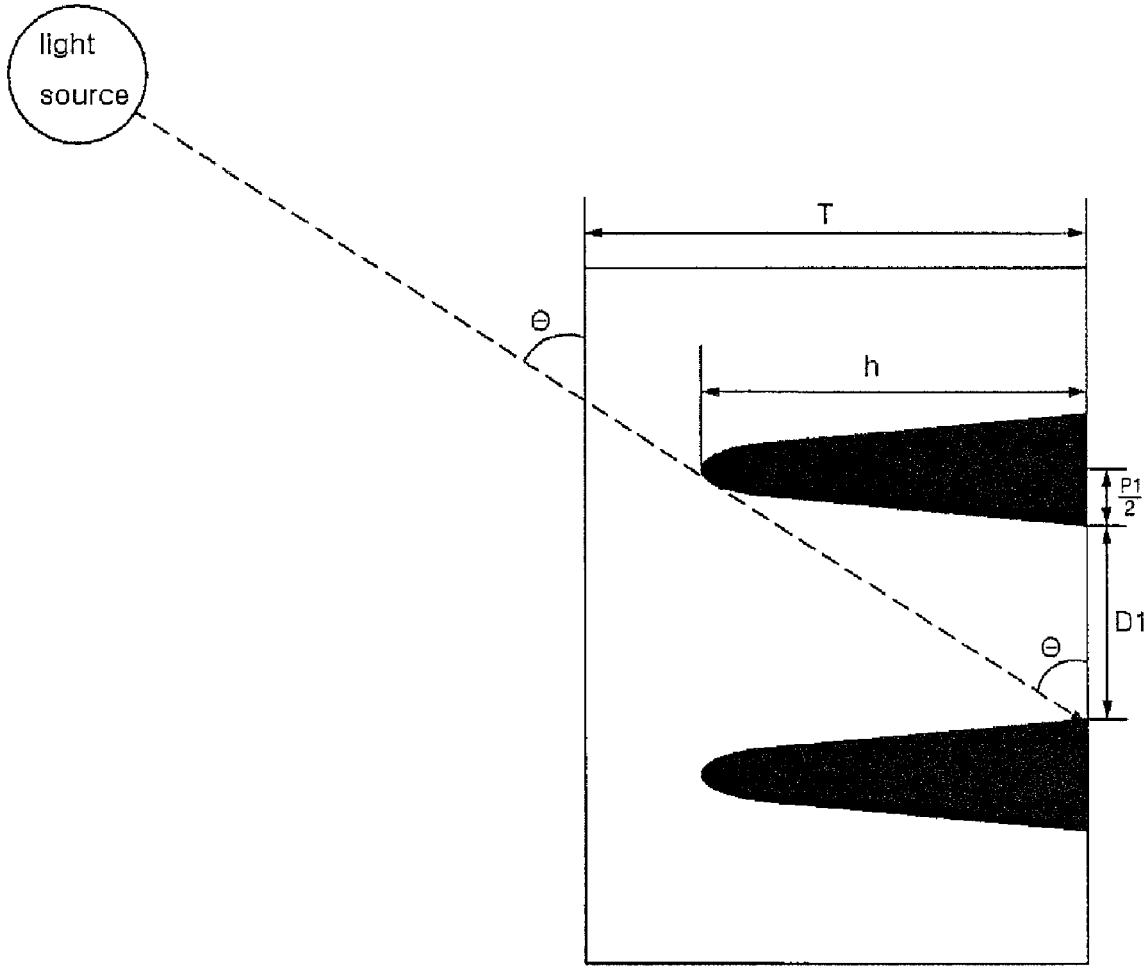
FIG. 26 is a cross-sectional view for explaining the relation between a distance of the adjacent pattern units formed on the sheet for protecting external light and a height of the pattern units.

FIG. 26 is a cross-sectional view illustrating a structure of the sheet for protecting external light to explain the relation between the thickness of the sheet for protecting external light and the height of the pattern units.

Referring to FIG. 26, the thickness T of the sheet for protecting external light is preferably set to 100 μm to 180 μm in order to obtain appropriate transmittance ratio of visible light emitted from the PDP for displaying images as well as to enhance the durability of the sheet for protecting external light including the pattern units.

When the height h of the pattern units provided in the sheet for protecting external light is 80 μm to 170 μm, the manufacture of the pattern units can be facilitated, the optimum aperture ratio of the sheet for protecting external light can be obtained, and the function of shielding external light and the function of reflecting light emitted from the PDP can be maximized.

The height h of the pattern units can be varied according to the thickness T of the sheet for protecting external light. In general, external light that considerably affects the bright room contrast of the PDP is highly likely to be incident upon the PDP from the above. Therefore, in order to effectively shield external light incident upon the PDP at an angle θ within a predetermined range, the height h of the pattern units is preferably within a predetermined percentage of the thickness T of the sheet for protecting external light.

As the height h of the pattern units increases, the thickness of the base unit, which is upper end region of the pattern units, decreases, and thus, dielectric breakdown may occur. On the other hand, as the height h of the pattern units decreases, more external light is likely to be incident upon the PDP at various angles within a predetermined range, and thus the sheet for protecting external light may not properly shield the external light.

Table 2 presents experimental results about the dielectric breakdown and the external light shielding effect of the sheet for protecting external light according to the thickness T of the sheet for protecting external light and the height h of the pattern units.

TABLE 2

| Thickness (T) of external light shielding sheet | Height (h) of pattern units | Dielectric breakdown | External light shielding |
|---|---|---|---|
| 120 μm | 120 μm | ○ | ○ |
| 120 μm | 115 μm | Δ | ○ |
| 120 μm | 110 μm | X | ○ |
| 120 μm | 105 μm | X | ○ |
| 120 μm | 100 μm | X | ○ |
| 120 μm | 95 μm | X | ○ |
| 120 μm | 90 μm | X | ○ |
| 120 μm | 85 μm | X | Δ |
| 120 μm | 80 μm | X | Δ |

TABLE 2-continued

| Thickness (T) of external light shielding sheet | Height (h) of pattern units | Dielectric breakdown | External light shielding |
|---|---|---|---|
| 120 μm | 75 μm | X | Δ |
| 120 μm | 70 μm | X | Δ |
| 120 μm | 65 μm | X | Δ |
| 120 μm | 60 μm | X | Δ |
| 120 μm | 55 μm | X | Δ |
| 120 μm | 50 μm | X | X |

Referring to Table 2, when the thickness T of the sheet for protecting external light is 120 μm or more, and the height h of the pattern units is 115 μm or more, the pattern units are highly likely to dielectric breakdown, thereby increasing defect rates of the product. When the height h of the pattern units is 115 μm or less, the pattern units are less likely to dielectric breakdown, thereby reducing defect rates of the sheet for protecting external light. However, when the height h of the pattern units is 85 μm or less, the shielding efficiency of external light may be reduced, and when the height h of the pattern units is 60 μm or less, external light is likely to be directly incident upon the PDP. Therefore, when the height h of the pattern units is 90 μm to 110 μm, the shielding efficiency of the sheet for protecting external light may be increased as well as the defect rates of the sheet for protecting external light may be decreased.

In addition, when the thickness T of the sheet for protecting external light is 1.01 to 2.25 times greater than the height h of the pattern units, it is possible to prevent the upper end portion of the pattern units 1210 from dielectrically breaking down and to prevent external light from being incident upon the PDP. Also, in order to prevent dielectric breakdown and infiltration of external light into the PDP, to increase the reflection of light emitted from the PDP, and to secure optimum viewing angles, the thickness T of the sheet for protecting external light may be 1.01 to 1.5 times greater than the height h of the pattern units.

Table 3 presents experimental results about the occurrence of the moire phenomenon and the external light shielding effect of the sheet for protecting external light according to different pattern unit lower end width of the sheet for protecting external light-to-bus electrode width ratios, formed on the upper substrate of the PDP, when the width of the bus electrode is 70 μm.

TABLE 3

| Lower end width of pattern units/Width of bus electrodes | Moire | External light shielding |
|---|---|---|
| 0.10 | Δ | X |
| 0.15 | Δ | X |
| 0.20 | X | Δ |
| 0.25 | X | ○ |
| 0.30 | X | ○ |
| 0.35 | X | ○ |
| 0.40 | X | ○ |
| 0.45 | Δ | ○ |
| 0.50 | Δ | ○ |
| 0.55 | ○ | ○ |
| 0.60 | ○ | ○ |

Referring to Table 3, when the lower end width of the pattern units is 0.2 to 0.5 times greater than the bus electrode width, the moire phenomenon can be reduced as well as external light incident upon the PDP can be reduced. Also, in order to prevent the moire phenomenon, to effectively shield external light, and to secure a sufficient aperture ratio for discharging light emitted from the PDP, the lower end width of the pattern units is preferably 0.25 to 0.4 times greater than the bus electrode width.

Table 4 presents experimental results about the occurrence of the moire phenomenon and the external light shielding effect according to different pattern unit lower end width of the sheet for protecting external light-to-vertical barrier rib width ratios, formed on the lower substrate of the PDP, when the width of the vertical barrier rib is 50 μm.

TABLE 4

| Lower end widths of pattern units/Upper end width of vertical barrier ribs | Moire | External light shielding |
|---|---|---|
| 0.10 | ○ | X |
| 0.15 | Δ | X |
| 0.20 | Δ | X |
| 0.25 | Δ | X |
| 0.30 | X | Δ |
| 0.35 | X | Δ |
| 0.40 | X | ○ |
| 0.45 | X | ○ |
| 0.50 | X | ○ |
| 0.55 | X | ○ |
| 0.60 | X | ○ |
| 0.65 | X | ○ |
| 0.70 | Δ | ○ |
| 0.75 | Δ | ○ |
| 0.80 | Δ | ○ |
| 0.85 | ○ | ○ |
| 0.90 | ○ | ○ |

Referring to Table 4, when the lower end width of the pattern units is 0.3 to 0.8 times greater than the upper end width of the vertical barrier rib, the moire phenomenon can be reduced as well as external light incident upon the PDP can be reduced. Also, in order to prevent the moire phenomenon, to effectively shield external light, and to secure a sufficient aperture ratio for discharging light emitted from the PDP, the lower end width of the pattern units is preferably 0.4 to 0.65 times greater than the upper end width of the vertical barrier rib.

As described above, the filter including the sheet for protecting external light according to the present invention can be formed in a film filter type attached to the PDP using the adhesive layer, to the contrary, it can be formed in a glass filter type including glass and disposed spaced from the PDP.

While the present invention has been particularly shown and described with reference to exemplary embodiments thereof, it will be understood by those of ordinary skill in the art that various changes in form and details may be made therein without departing from the spirit and scope of the present invention as defined by the following claims. It is, therefore, intended that such changes and modifications be covered by the following claims.

What is claimed is:

1. A plasma display device including:

a plasma display panel (PDP); and a filter formed in front of the panel, wherein the filter includes:

a base unit; and an external light shielding sheet including a plurality of pattern units provided in a spaced relation adjacent the base unit to absorb external light, wherein:

the base unit includes dye or pigment absorbing light in a specific wavelength region, refractive indexes of the pattern units are greater than a refractive index of the base unit, and a difference between the refractive indexes of the pattern units and the refractive index of the base unit lies substantially in a range of 0.05 to 0.3.

2. The plasma display device as claimed in claim 1, wherein the base unit includes dye or pigment absorbing NIR rays having a wavelength of 800 nm to 1100 nm.

3. The plasma display device as claimed in claim 2, wherein the base unit includes at least one of a diimonium-based dye, a phthalocyanine-based dye, a naphthalocyanine-based dye, or a metal-complex-based dye.

4. The plasma display device as claimed in claim 1, wherein the base unit includes dye or pigment absorbing a neon light having a wavelength of 570 nm to 600 nm.

5. The plasma display device as claimed in claim 4, wherein the base unit includes at least one of an amine-based dye, a polymethine-based dye, a porphyrin-based dye, or a cyanin-based dye.

6. The plasma display device as claimed in claim 1, wherein the base unit includes at least one of an anthraquinone-based dye, a phthalocyanine-based dye, or a thioindigo-based dye.

7. The plasma display device as claimed in claim 1, wherein the base unit includes dye or pigment absorbing red light.

8. The plasma display device as claimed in claim 1, wherein the base unit includes dye or pigment absorbing green light.

9. The plasma display device as claimed in claim 1, wherein a thickness of the external light shielding sheet is substantially 1.01 to 2.25 times greater than a height of one or more of the pattern units.

10. The plasma display device as claimed in claim 1, wherein the refractive indexes of the pattern units are substantially 0.3 to 1 times greater than a refractive index of the base unit.

11. The plasma display device as claimed in claim 1, wherein an upper end of each of the pattern units, of which width is less than a lower end thereof, is disposed to be closer to the PDP.

12. The plasma display device as claimed in claim 1, wherein an average number of the pattern units overlapped with one of a plurality of discharge cells formed on the PDP is substantially 3.9 to 13.9.

13. The plasma display device as claimed in claim 1, wherein an average number of the pattern units overlapped with one of a plurality of discharge cells formed on the PDP is substantially 6 to 13.5.

14. A filter formed in front of a plasma display panel, the filter including:

a base unit; and an external light shielding sheet including a plurality of pattern units formed in a spaced relation adjacent to the base unit to absorb external light, wherein the base unit includes dye or pigment absorbing light in a specific wavelength region, wherein refractive indexes of the pattern units are greater than a refractive index of the base unit, and wherein a difference between the refractive indexes of the pattern units and the refractive index of the base unit is substantially 0.05 to 0.3.

15. The filter as claimed in claim 14, wherein the base unit includes dye or pigment absorbing NIR rays having a wavelength of 800 nm to 1100 nm.

16. The filter as claimed in claim 14, wherein the base unit includes dye or pigment absorbing a neon light having a wavelength of 570 nm to 600 nm.

17. The filter as claimed in claim 14, wherein the base unit includes at least one of an anthraquinone-based dye, a phthalocyanine-based dye, or a thioindigo-based dye.

18. The filter as claimed in claim 14, wherein a thickness of the external light shielding sheet is substantially 1.01 to 2.25 times greater than a height of at least one of the pattern units.

19. The plasma display device as claimed in claim 1, wherein the pattern units have substantially a same refractive index greater than the refractive index of the base unit.

20. The plasma display device as claimed in claim 1, wherein the each of the pattern units includes a groove and wherein a depth of the groove formed in a lower end of each of the pattern units is 1.5 μm to 7.0 μm.

21. The plasma display device as claimed in claim 20, wherein a lower end width of each of the pattern units is 3.6 to 17.5 times greater than a depth of the groove formed in the lower end of each of the pattern units.

22. The filter as claimed in claim 14, wherein the pattern units have substantially a same refractive index greater than the refractive index of the base unit.

23. The filter as claimed in claim 14, wherein the each of the pattern units includes a groove and wherein a depth of the groove formed in a lower end of each of the pattern units is 1.5 μm to 7.0 μm.

24. The filter as claimed in claim 23, wherein a lower end width of each of the pattern units is 3.6 to 17.5 times greater than a depth of the groove formed in the lower end of each of the pattern units.

* * * * *